US010279363B2

(12) United States Patent
Kakuta

(10) Patent No.: US 10,279,363 B2
(45) Date of Patent: May 7, 2019

(54) TRIGGER-TYPE LIQUID EJECTOR

(71) Applicant: Yoshiyuki Kakuta, Tokyo (JP)

(72) Inventor: Yoshiyuki Kakuta, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 16/065,204

(22) PCT Filed: Dec. 22, 2016

(86) PCT No.: PCT/JP2016/088412
§ 371 (c)(1),
(2) Date: Jun. 22, 2018

(87) PCT Pub. No.: WO2017/111040
PCT Pub. Date: Jun. 29, 2017

(65) Prior Publication Data

US 2018/0369842 A1 Dec. 27, 2018

(30) Foreign Application Priority Data

Dec. 25, 2015 (JP) ..... 2015-253537
May 31, 2016 (JP) ..... 2016-108118

(51) Int. Cl.
*B05B 11/00* (2006.01)
*B65D 83/00* (2006.01)
(Continued)

(52) U.S. Cl.
CPC ..... *B05B 11/3011* (2013.01); *B05B 11/00* (2013.01); *B05B 11/3066* (2013.01);
(Continued)

(58) Field of Classification Search
CPC . B05B 11/3011; B05B 11/00; B05B 11/3066; B05B 11/3002; B05B 83/00; B05B 83/202; B05B 83/32
(Continued)

(56) References Cited

U.S. PATENT DOCUMENTS 4,191,313 A * 3/1980 Blake ..... B05B 11/0064 222/335
4,958,754 A * 9/1990 Dennis ..... B05B 11/0044 222/383.1
(Continued)

FOREIGN PATENT DOCUMENTS

JP 3781904 B2 6/2006
JP 2013-158673 A 8/2013
(Continued)

OTHER PUBLICATIONS

Mar. 28, 2017 International Search Report issued in International Patent Application No. PCT/JP2016/088412.

*Primary Examiner* — Benjamin R Shaw
(74) *Attorney, Agent, or Firm* — Oliff PLC

(57) ABSTRACT

A trigger-type liquid ejector includes an ejector main body and a nozzle member. The ejector main body includes a vertical supply pipe, an ejection barrel and a trigger mechanism; and the trigger mechanism includes a main piston and a main cylinder. In the trigger-type liquid ejector, the ejector main body includes a connection tube, a closing-off plug, a reservoir cylinder, a reservoir plunger and a reservoir valve, and the ejection barrel extends forward from the reservoir cylinder.

6 Claims, 7 Drawing Sheets

(51) Int. Cl.
*B65D 83/20* (2006.01)
*B65D 83/32* (2006.01)

(52) U.S. Cl.
CPC ..... *B65D 83/00* (2013.01); *B65D 83/202* (2013.01); *B65D 83/32* (2013.01)

(58) Field of Classification Search
USPC ..... 222/382
See application file for complete search history.

(56) References Cited

U.S. PATENT DOCUMENTS

| | | | | | |
|---|---|---|---|---|---|
| 5,228,602 | A * | 7/1993 | Maas | B05B 11/3011 | 222/340 |
| 5,984,149 | A * | 11/1999 | Thanisch | B05B 11/007 | 222/340 |
| 7,571,836 | B2 * | 8/2009 | Foster | B05B 11/3011 | 222/340 |
| 7,637,396 | B2 * | 12/2009 | Foster | B05B 11/3011 | 222/340 |
| 8,905,270 | B2 * | 12/2014 | Alluigi | B05B 11/3011 | 222/321.8 |
| 9,033,190 | B2 * | 5/2015 | Alluigi | B05B 11/3011 | 222/321.8 |
| 9,283,581 | B2 * | 3/2016 | Alluigi | B05B 11/3011 | |
| 9,675,985 | B2 * | 6/2017 | Alluigi | B05B 11/3011 | |
| 2017/0216863 | A1 * | 8/2017 | Kakuta | B05B 15/30 | |

FOREIGN PATENT DOCUMENTS

| | | | |
|---|---|---|---|
| JP | 2014-147890 | A | 8/2014 |
| JP | 2014-166624 | A | 9/2014 |

* cited by examiner

TRIGGER-TYPE LIQUID EJECTOR

TECHNICAL FIELD

The present invention relates to a trigger-type liquid ejector. Priority is claimed on Japanese Patent Application No. 2015-253537, filed Dec. 25, 2015, and Japanese Patent Application No. 2016-108118, filed May 31, 2016, the contents of which are incorporated herein by reference.

BACKGROUND ART

A trigger-type liquid ejector configured to suction a liquid from a container body and eject the liquid from a nozzle using an operation of a trigger extending downward from the nozzle is known (for example, the following Patent Document 1). In the trigger-type liquid ejector of the related art, an ejection barrel extending forward is formed on a vertical supply pipe communicating with the container body. The nozzle is attached to a tip side of the ejection barrel. A cylinder operated by the operation of the trigger is disposed below the ejection barrel. Then, when the operation of the trigger is performed, the liquid can be injected (ejected) forward from the ejection barrel via the nozzle while the liquid can be suctioned from the vertical feed tube into the cylinder.

CITATION LIST

Patent Document

Patent Document 1

Japanese Patent No. 3781904

SUMMARY OF INVENTION

Technical Problem

However, in the trigger-type liquid ejector of the related art, the liquid is injected only when the trigger is pulled. Accordingly, for example, when the liquid is sprayed over a wide area, it is troublesome to repeat the operation of pulling the trigger many times.

In consideration of the above-mentioned circumstances, the present invention is directed to providing a trigger-type liquid ejector capable of continuously injecting a liquid.

Solution to Problem

In order to solve the problems, the present invention proposes the following means. A first aspect of the present invention is a trigger-type liquid ejector includes: a ejector main body mounted on a container body in which a liquid is contained; and a nozzle member disposed in front of the ejector main body and in which an ejection hole configured to inject a liquid forward is formed. The ejector main body includes: a vertical supply pipe extending in an upward/downward direction and configured to suction the liquid in the container body, an ejection barrel disposed in front of the vertical supply pipe and configured to guide the liquid in the vertical supply pipe into the ejection hole, and a trigger mechanism having a trigger disposed to be movable rearward while being pushed forward from the vertical supply pipe and configured to cause the liquid to flow from an inside of the vertical supply pipe toward the ejection hole through the inside of the ejection barrel through rearward movement of the trigger. The trigger mechanism includes: a main piston that moves in a forward/rearward direction in conjunction with movement of the trigger; and a main cylinder having the inside that is compressed and decompressed according to the movement of the main piston and communicates with the inside of the vertical supply pipe. The ejector main body includes: a connection tube extending forward from the vertical supply pipe, a closing-off plug formed integrally with the main cylinder and configured to close a front end opening of the connection tube; a reservoir cylinder having a supply hole communicating with the inside of the connection tube and a communication hole communicating with the inside of the ejection barrel, and into which the liquid passing through the inside of the vertical supply pipe and the inside of the connection tube is supplied through the supply hole due to rearward movement of the trigger, a reservoir plunger disposed in the reservoir cylinder to be movable along a central axis thereof in an axial direction and pushed toward the other side while moving to one side in the axial direction according to supply of the liquid to the reservoir cylinder, and a reservoir valve configured to restrict outflow of the liquid from the inside of the reservoir cylinder into the connection tube through the supply hole while allowing supply of the liquid from the inside of the connection tube into the reservoir cylinder through the supply hole. The ejection barrel extends forward from the reservoir cylinder.

According to the first aspect of the present invention, when the trigger is pulled rearward in a state in which the trigger is mounted on the container body in which the liquid is contained, the main piston is moved in the main cylinder in the forward/rearward direction and the inside of the main cylinder is pressurized, and the liquid in the main cylinder is supplied into the vertical supply pipe. The liquid is injected from the ejection hole through the connection tube, the supply hole, the reservoir cylinder, and the inside of the ejection barrel, and the liquid is also accumulated in the reservoir cylinder. The reservoir plunger in the reservoir cylinder is moved toward one side in the axial direction according to storage of the liquid in the reservoir cylinder. In this way, whenever an operation of pulling the trigger is performed, the liquid can be accumulated in (filled into) the reservoir cylinder by moving the reservoir plunger to the one side in the axial direction while injecting the liquid from the ejection hole. Then, when the operation of pulling the trigger is stopped, while supply of the liquid to the vertical supply pipe is stopped, return movement of the reservoir plunger toward the other side in the axial direction is started due to the pushing force applied to the reservoir plunger. Accordingly, since the liquid filled into the reservoir cylinder is pushed out of the inside of the reservoir cylinder toward the ejection hole through the ejection barrel, the liquid can be continuously injected from the ejection hole. Here, outflow of the liquid from the inside of the reservoir cylinder into the connection tube is restricted by the reservoir valve. Accordingly, the liquid can be injected and continuous injection of the liquid can be performed not only when the operation of pulling the trigger rearward is being performed but also when the trigger is not being operated. Further, when the reservoir plunger is returned and moved toward the other side in the axial direction, while the reservoir plunger is moved to the end of reservoir cylinder on the other side in the axial direction if the trigger is not pulled again, the operation of pulling the trigger can be repeated before that. In this case, movement of the reservoir plunger between the one side and the other side in the axial direction within a substantially constant width is repeated, and the reservoir plunger is slowly moved to one side in the axial direction as a whole. Accordingly, the liquid is gradually accumulated in the reservoir cylinder. In addition, when the liquid in the reservoir cylinder is ejected from the ejection hole, outflow of the liquid from the reservoir cylinder into the connection tube can be restricted by the reservoir valve. Accordingly, for example, the pressure of the liquid ejected from the ejection hole through the ejection barrel can be easily increased, and the liquid can be ejected in an appropriate form or the like. In addition, since the closing-off plug is formed integrally with the main cylinder, an increase in the number of parts can be minimized.

A second aspect of the present invention is the trigger-type liquid ejector of the first aspect, where the connection tube and the reservoir cylinder are disposed parallel to each other in the upward/downward direction and include a common partition wall.

According to the second aspect of the present invention, since the connection tube and the reservoir cylinder are disposed parallel to each other in the upward/downward direction to include the common partition wall, reduction in size of the ejector main body can be achieved.

A third aspect of the present invention is the trigger-type liquid ejector of the first or second aspect, where a collecting passage configured to bring the inside of the reservoir cylinder and the inside of the container body in communication with each other when the reservoir plunger is moved toward the one side is installed in the ejector main body.

According to the third aspect of the present invention, the collecting passage is installed in the ejector main body. Accordingly, in a state in which the reservoir plunger is sufficiently moved to the one side in the axial direction, when the liquid is further introduced into the reservoir cylinder, the liquid can be returned to the container body from the collecting passage. As a result, an excessive increase of the pressure in the reservoir cylinder can be minimized, and for example, damage or the like to the reservoir cylinder can be easily prevented.

A fourth aspect of the present invention is the trigger-type liquid ejector of the first aspect, where the vertical supply pipe includes an outer tube and an inner tube fitted into the outer tube, a collecting passage configured to bring the inside of the reservoir cylinder and the inside of the container body in communication with each other when the reservoir plunger is moved toward the one side and disposed between the outer tube and the inner tube, and a communication tube protruding from the main cylinder in the forward/rearward direction, fitted into a second through-hole formed in the inner tube through a first through-hole formed in the outer tube and configured to bring the inside of the vertical supply pipe and the inside of the main cylinder in communication with each other is installed in the main cylinder.

According to the fourth aspect of the present invention, the collecting passage is installed on the ejector main body. Accordingly, in a state in which the reservoir plunger is sufficiently moved to the one side in the axial direction, when the liquid is further introduced into the reservoir cylinder, the liquid can be returned to the container body from the collecting passage. Accordingly, an excessive increase in the pressure in the reservoir cylinder can be minimized, and for example, damage or the like to the reservoir cylinder can be easily prevented. In addition, the communication tube is fitted into the second through-hole. Accordingly, even when sealability between the outer circumferential surface of the communication tube and the inner circumferential surface of the first through-hole is not secured, since sealability between the outer circumferential surface of the communication tube and the inner circumferential surface of the second through-hole is secured, leakage of contents in the vertical supply pipe to the outside through the first through-hole or a short circuit between the inside of the vertical supply pipe and the collecting passage can be minimized.

A fifth aspect of the present invention is the trigger-type liquid ejector of the fourth aspect, where the ejector main body includes a suction valve disposed in the vertical supply pipe and configured to switch between allowing communication between the inside of the container body and the inside of the main cylinder and blocking communication therebetween, the suction valve is closed when the inside of the main cylinder is pressurized and communication between the inside of the container body and the inside of the main cylinder through the inside of the vertical supply pipe is blocked, the suction valve is opened by being displaced or deformed upward when the inside of the main cylinder is decompressed, and allows the inside of the container body and the inside of the main cylinder to communicate with each other through the inside of the vertical supply pipe, the communication tube protrudes into the inner tube, and a portion of the communication tube disposed in the inner tube is a valve pressing section locked to the suction valve when the suction valve is open and configured to restrict further upward displacement and deformation of the suction valve.

According to the fifth aspect of the present invention, the portion of the communication tube disposed in the inner tube is the valve pressing section. Accordingly, excessive displacement or deformation of the suction valve can be minimized while suppressing an increase in the number of parts.

A sixth aspect of the present invention is the trigger-type liquid ejector of the fourth aspect, where the connection tube and the reservoir cylinder are disposed parallel to each other in the upward/downward direction to include a common partition wall.

According to the sixth aspect of the present invention, since the connection tube and the reservoir cylinder are disposed parallel to each other in the upward/downward direction to include the common partition wall, reduction in size of the ejector main body can be achieved.

Advantageous Effects of Invention

According to the present invention, continuous injection of a liquid becomes possible.

DESCRIPTION OF EMBODIMENTS

First Embodiment

Figure 1:
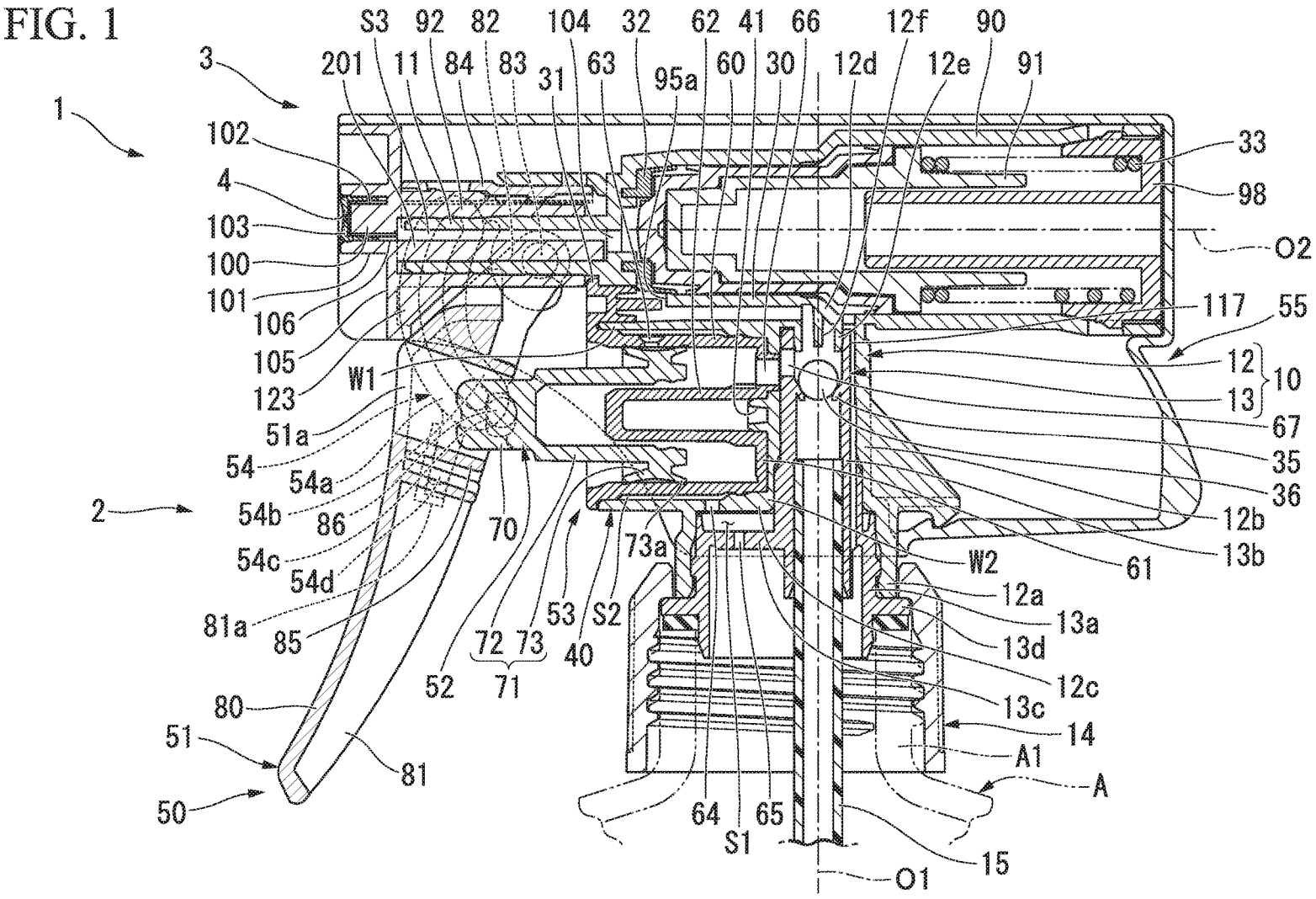
FIG. 1 is a longitudinal cross-sectional view showing a first embodiment of a trigger-type liquid ejector according to the embodiment.
Figure 2:
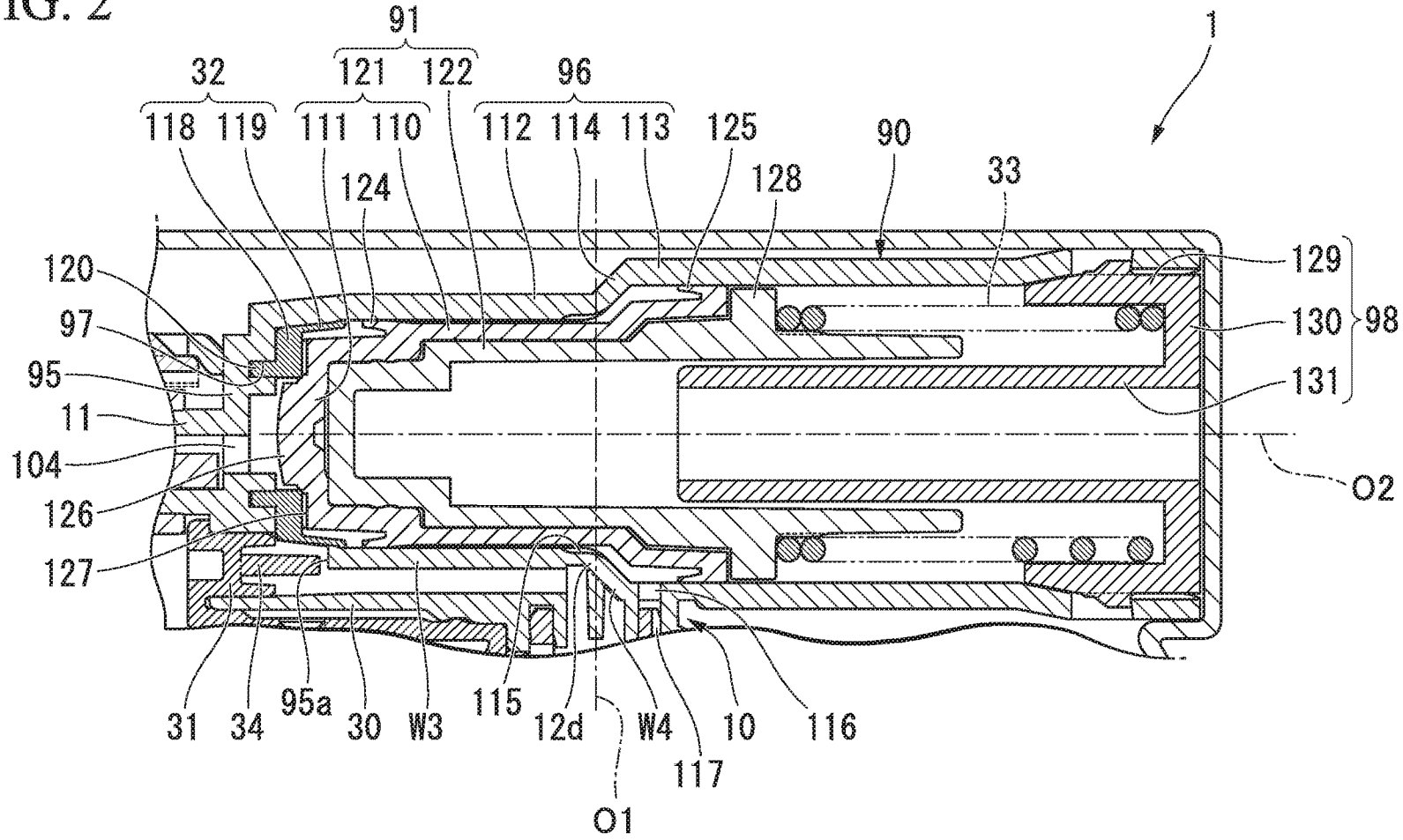
FIG. 2 is an enlarged longitudinal cross-sectional view of a major part including a reservoir cylinder that constitutes the trigger-type liquid ejector shown in FIG. 1.

Hereinafter, a first embodiment of a trigger-type liquid ejector according to the present invention will be described with reference to FIGS. 1 to 3. As shown in FIGS. 1 and 2, a trigger-type liquid ejector 1 of the first embodiment includes a ejector main body 2 mounted on a container body A that accommodates a liquid and having a vertical supply pipe 10 configured to suction a liquid, and a nozzle member 3 having an ejection hole 4 formed to eject the liquid forward and mounted on the ejector main body 2. Further, components of the trigger-type liquid ejector 1 are assumed to be articles molded from synthetic resins unless the context clearly indicates otherwise.

Here, in the first embodiment, a central axis of the vertical supply pipe 10 is referred to as an axis O1, the container body A side along the axis O1 is referred to as a lower side, and a side opposite thereto is referred to as an upper side. In addition, a direction perpendicular to the axis O1 is referred to as a forward/rearward direction, and a direction perpendicular to both of the axis O1 direction and the forward/rearward direction is referred to as a leftward/rightward direction.

The ejector main body 2 includes the vertical supply pipe 10 extending in the upward/downward direction, and an ejection barrel 11 disposed in front of the vertical supply pipe 10 and having an inside communicating with the inside of the vertical supply pipe 10. The ejector main body 2 further includes a connection tube 30, a closing-off plug 31, a cylindrical tube 40, a reservoir cylinder 90, a reservoir valve 32, a reservoir plunger 91, a restricting section 98 and a pushing member 33. Further, in the forward/rearward direction, a direction in which the ejection barrel 11 is disposed from the vertical supply pipe 10 is referred to as toward the front side or forward, and a direction opposite thereto is referred to as toward the rear side or rearward.

The vertical supply pipe 10 includes an outer tube 12 having a cylindrical form with a top, and an inner tube 13 fitted into the outer tube 12. The outer tube 12 includes a large-diameter section 12*a*, a small-diameter section 12*b* disposed above the large-diameter section 12*a* and having a diameter smaller than the large-diameter section 12*a*, and a flange portion 12*c* configured to connect an upper end portion of the large-diameter section 12*a* to a lower end portion of the small-diameter section 12*b*, and formed in a two-part tubular form having a diameter decreasing upward from the bottom. Further, an upper end opening mouth section of the small-diameter section 12*b* is covered with a top wall section 12*d*. A seal tube 12*e* and a restricting protrusion 12*f* are formed on the top wall section 12*d*. Both of the seal tube 12*e* and the restricting protrusion 12*f* extend downward from the top wall section 12*d* and are disposed coaxially with the axis O1. The seal tube 12*e* surrounds the restricting protrusion 12*f* from the outside.

The inner tube 13 includes a large-diameter section 13*a*, a small-diameter section 13*b* disposed above the large-diameter section 13*a* and having a diameter smaller than the large-diameter section 13*a* and a flange portion 13*c* configured to connect an upper end portion of the large-diameter section 13*a* and a lower end portion of the small-diameter section 13*b*, and is formed in a two-part tubular form having a diameter decreasing upward from the bottom. The seal tube 12*e* is fitted into an upper end portion of the small-diameter section 13*b*.

An upper portion of a pipe 15 disposed in the container body A and having a lower end opening positioned on a bottom portion (not shown) of the container body A is fitted into the small-diameter section 13*b* of the inner tube 13. The flange portion 13*c* of the inner tube 13 is disposed below the flange portion 12*c* of the outer tube 12 in a state in which a gap S1 is secured between the flange portion 12*c* of the outer tube 12 and the flange portion 13*c*. An annular brim portion 13*d* protruding toward the outside in the radial direction is formed on a portion of the large-diameter section 13*a* of the inner tube 13 protruding downward from the large-diameter section 12*a* of the outer tube 12. The brim portion 13*d* is disposed in an upper end portion of a mounting cap 14 mounted (for example, threadedly mounted) in a mouth section A1 of the container body A, and rotatably locks an upper end portion of the mounting cap 14 about the axis. The brim portion 13*d* is sandwiched between the mounting cap 14 and an upper end opening edge in the mouth section A1 of the container body A in the upward/downward direction. Further, the axis O1 of the vertical supply pipe 10 constituted by the outer tube 12 and the inner tube 13 is eccentric toward the rearward side with respect to the container shaft of the container body A.

An annular tapered tube 35 protruding inward is formed on a portion of an inner circumferential surface of the inner tube 13 disposed below the seal tube 12*e* and above an upper end of the pipe 15. The tapered tube 35 has a diameter that gradually decreases downward. A spherical suction valve 36 that is seated on an inner circumferential surface of the tapered tube 35 and able to move away therefrom is disposed inside the tapered tube 35. The suction valve 36 brings a space in the inner tube 13 disposed above the tapered tube 35 and a space below the tapered tube 35 in communication with each other and blocks communication between these spaces.

The connection tube 30 extends forward from the vertical supply pipe 10. The connection tube 30 communicates with the inside of the vertical supply pipe 10. A rear end portion of the connection tube 30 is connected to a front side of an upper end portion of vertical supply pipe 10. A rear end opening of the connection tube 30 opens in the seal tube 12*e*. The closing-off plug 31 closes the front end opening of the connection tube 30. The closing-off plug 31 is tightly fitted into the connection tube 30. A protrusion portion 34 protruding rearward is formed on the closing-off plug 31. The protrusion portion 34 reduces a flow path cross-sectional area of the connection tube 30.

The cylindrical tube 40 is formed integrally with a portion of the outer tube 12 disposed below the connection tube 30. The cylindrical tube 40 protrudes forward from the outer tube 12 and opens forward. The cylindrical tube 40 is disposed between the connection tube 30 and the flange portion 12*c*. The cylindrical tube 40 is parallel to the connection tube 30 and the flange portion 12*c* in the upward/downward direction. The cylindrical tube 40 includes common partition walls W1 and W2 that are shared by the connection tube 30 and the flange portion 12*c*.

A supply hole 95*a* in communication with the inside of the connection tube 30 is formed in the reservoir cylinder 90. A liquid passing through the inside of the vertical supply pipe 10 and the inside of the connection tube 30 is supplied into the reservoir cylinder 90 through the supply hole 95*a* by swinging (moving) a trigger 51 (to be described below) rearward. The reservoir cylinder 90 is disposed above the connection tube 30 while extending in the forward/rearward direction. The connection tube 30 and the reservoir cylinder 90 are disposed parallel to each other in the upward/downward direction to include a common partition wall W3. The reservoir cylinder 90 is disposed parallel to the connection tube 30 and the cylindrical tube 40. Further, in the example shown, the reservoir cylinder 90 is also disposed above the vertical supply pipe 10. The vertical supply pipe 10 and the reservoir cylinder 90 include a common partition wall W4. The partition wall W4 is constituted by the top wall section 12*d*.

As shown in FIG. 2, the reservoir cylinder 90 includes a front wall portion 95 and a cylinder tube 96 extending rearward from the front wall portion 95, and is formed in a cylindrical shape that opens rearward. A mounting concave portion 97 and a communication hole 104 are formed in the front wall portion 95. The mounting concave portion 97 is annularly formed coaxially with a central axis O2 of the reservoir cylinder 90. The mounting concave portion 97 is formed in a rear end surface of the front wall portion 95. The communication hole 104 is disposed inside the mounting concave portion 97 in a front view in which the front wall portion 95 is seen from the forward/rearward direction. The communication hole 104 passes through the front wall portion 95 in the forward/rearward direction.

The cylinder tube 96 is formed in a multi-stage tubular form having a diameter that gradually increases from the front side toward the rear side. The cylinder tube 96 includes a front tube 112 having a small diameter, a rear tube 113 having a large diameter, and a step portion 114 configured to connect the front tube 112 and the rear tube 113. The step portion 114 has a diameter that is gradually increased from the front side toward the rear side. The rear tube 113 protrudes rearward from the vertical supply pipe 10. The front tube 112 constitutes the partition wall W3. Front end portions of the step portion 114 and the rear tube 113 constitute the partition wall W4.

The supply hole 95*a*, a communicating groove 115 and a collecting hole 116 are formed in the cylinder tube 96. The supply hole 95*a* is formed in the front end portion of the front tube 112. The supply hole 95*a* passes through the partition wall W3 in the upward/downward direction. The supply hole 95*a* exposes the protrusion portion 34 upward. The communicating groove 115 is formed in the rear end portion of the front tube 112. The communicating groove 115 is formed in an inner circumferential surface of the front tube 112. The communicating groove 115 extends in the forward/rearward direction and opens rearward. A plurality of communicating grooves 115 are disposed around the central axis O2 at intervals. The collecting hole 116 is disposed in the front end portion of the rear tube 113. The collecting hole 116 passes through the partition wall W4 in the upward/downward direction. The collecting hole 116 comes in communication with a collecting passage 117 formed in the ejector main body 2. As shown in FIG. 1, the collecting passage 117 traverses the vertical supply pipe 10 in the upward/downward direction. The collecting passage 117 passes through the small-diameter section 13*b* in the upward/downward direction and comes in communication with the inside of the large-diameter section 13*a*. The collecting passage 117 brings the collecting hole 116 and the inside of the container body A in communication with each other.

As shown in FIG. 2, the reservoir valve 32 allows supply of a liquid from the inside of the connection tube 30 into the reservoir cylinder 90 through the supply hole 95*a*. The reservoir valve 32 restricts outflow of the liquid from the inside of the reservoir cylinder 90 into the connection tube 30 through the supply hole 95*a*. The reservoir valve 32 is a check valve. The reservoir valve 32 includes a valve base portion 118 and a valve body portion 119. The valve base portion 118 is annularly formed coaxially with the central axis O2. The valve base portion 118 is disposed on the rear end surface of the front wall portion 95. The valve base portion 118 includes a mounting convex portion 120 mounted in the mounting concave portion 97. The valve body portion 119 is formed in a cylindrical shape protruding rearward from the valve base portion 118. The valve body portion 119 can be elastically deformed toward the inside thereof in the radial direction. The rear end portion of the valve body portion 119 is seated on the inner circumferential surface of the cylinder tube 96 and able to move away therefrom. The rear end portion of the valve body portion 119 is behind the supply hole 95*a*. The valve body portion 119 may be closed to freely open and close the supply hole 95*a* from the inside of the reservoir cylinder 90.

The reservoir plunger 91 is movably disposed in the reservoir cylinder 90 in order to be movable along the central axis O2 in the forward/rearward direction (the axial direction). The reservoir plunger 91 is pushed toward the front side (the other side) while moving toward the rear side (one side) in the forward/rearward direction according to supply of the liquid to the reservoir cylinder 90. The reservoir plunger 91 includes a sliding member 121 and a receiving member 122. Both of the sliding member 121 and the receiving member 122 are formed in a cylindrical shape extending in the forward/rearward direction. The sliding member 121 is fitted onto the receiving member 122. The sliding member 121 may be formed of, for example, a material that is softer than the receiving member 122.

The sliding member 121 slides in the reservoir plunger 91 in the forward/rearward direction. The sliding member 121 includes a plunger tube 110 extending in the forward/rearward direction, and a closing wall 111 configured to close the front end opening of the plunger tube 110. The plunger tube 110 is formed in a multi-stage cylindrical shape having a diameter that is gradually increased from the front side toward the rear side. Lip portions 124 and 125 are formed on an outer circumferential surface of the plunger tube 110. The lip portions 124 and 125 are formed in the circumferential direction of the plunger tube 110 throughout the circumference thereof. The lip portions 124 and 125 tightly slide on the inner circumferential surface of the cylinder tube 96 in the forward/rearward direction. The pair of lip portions 124 and 125 are disposed in the forward/rearward direction with an interval therebetween. The lip portions 124 and 125 include the first lip portion 124 on the front side, and the second lip portion 125 on the rear side. The first lip portion 124 slides on the inner circumferential surface of the front tube 112. The second lip portion 125 slides on the inner circumferential surface of the rear tube 113.

The front end surface of the closing wall 111 can abut the rear end surface of the valve base portion 118. Accordingly, the closing wall 111 may close the communication hole 104. The closing wall 111 is seated on the valve base portion 118 and is able to move away therefrom toward the rear side. A convex portion 126 and a concave groove 127 are formed on the front end surface of the closing wall 111. The convex portion 126 protrudes forward from the closing wall 111.

The convex portion 126 is disposed in the valve base portion 118. The concave groove 127 extends in the radial direction of the reservoir plunger 91. The concave groove 127 opens toward the outside in the radial direction. In a state in which the front end surface of the closing wall 111 abuts the rear end surface of the valve base portion 118, communication between the concave groove 127 and the communication hole 104 is blocked. The rear end portion of the receiving member 122 protrudes rearward from the sliding member 121. A receiving seat portion 128 is formed on the receiving member 122. The receiving seat portion 128 protrudes from the outer circumferential surface of the receiving member 122 in the radial direction of the receiving member 122. The receiving seat portion 128 is formed in an annular shape extending in the circumferential direction of the receiving member 122 throughout the circumference thereof.

The restricting section 98 restricts a moving amount of the reservoir plunger 91 toward the rear side. The restricting section 98 is mounted in the rear end portion of the reservoir cylinder 90. The restricting section 98 is disposed coaxially with the central axis O2 and formed in a double tube shape extending in the forward/rearward direction. The restricting section 98 includes a fitting tube 129, a connecting seat portion 130 and an insertion tube 131. The fitting tube 129 is fitted into the reservoir cylinder 90. The connecting seat portion 130 is formed in an annular shape coaxial with the central axis O2. An outer circumferential edge portion of the connecting seat portion 130 is connected to the rear end portion of the fitting tube 129. The insertion tube 131 protrudes forward from the outer circumferential edge portion of the connecting seat portion 130. The front end portion of the insertion tube 131 is disposed in the receiving member 122. The connecting seat portion 130 faces the rear end portion of the receiving member 122 in the forward/rearward direction.

The pushing member 33 biases the reservoir plunger 91 forward. The pushing member 33 is disposed between the reservoir plunger 91 and the restricting section 98. The front end portion of the pushing member 33 is disposed on the rear end surface of the receiving seat portion 128. The rear end portion of the pushing member 33 is disposed on the front end surface of the connecting seat portion 130. The pushing member 33 is compressed in the forward/rearward direction and biases the reservoir plunger 91 forward in a state in which the reservoir plunger 91 is disposed at the furthest advanced position, which will be described below. The pushing member 33 is a coil spring that is fitted onto the rear end portion of the receiving member 122 and the insertion tube 131.

As shown in FIGS. 1 and 2, the ejection barrel 11 guides the liquid in the vertical supply pipe 10 to the ejection hole 4. The ejection barrel 11 extends forward from the reservoir cylinder 90. The ejection barrel 11 protrudes forward from the front wall portion 95. The inside of the ejection barrel 11 passes through the communication hole 104, the inside of the valve base portion 118, the inside of the reservoir cylinder 90, the supply hole 95*a* and the inside of the connection tube 30, and comes in communication with the inside of the ejection barrel 11.

As shown in FIG. 1, the ejector main body 2 further includes the trigger 51 extending downward from the ejection barrel 11 and disposed in front of the vertical supply pipe 10 to be swingably (movably) rearward in a state where the trigger 51 is pushed forward, a main piston 52 that moves in the forward/rearward direction in conjunction with the swinging (movement) of the trigger 51, a main cylinder 53 having an internal space that is compressed and decompressed according to movement of the main piston 52, elastic plate portions 54 configured to bias the trigger 51 forward, and a cover body 55 configured to cover the whole of the vertical supply pipe 10, the ejection barrel 11 and the reservoir cylinder 90 from at least above and the leftward/rightward direction.

In addition, the reservoir valve 32, the suction valve 36, the trigger 51, the main piston 52, the main cylinder 53 and the elastic plate portions 54, which are described above, constitute a trigger mechanism 50 configured to cause the liquid to flow from the inside of the vertical supply pipe 10 toward the ejection hole 4 through the inside of the ejection barrel 11 according to swinging (movement) of the trigger 51 toward the rear side.

The inside of the main cylinder 53 comes in communication with the inside of the vertical supply pipe 10. The main cylinder 53 includes an outer tube 60 that opens forward, a rear wall portion 61 configured to cover the rear opening portion of the outer tube 60, and a piston guide 62 having a front end closed while protruding forward from the central portion of the rear wall portion 61. The closing-off plug 31 is formed integrally with the main cylinder 53.

The piston guide 62 having the inside that opens rearward, and a fitting protrusion 41 protruding forward from the rear wall of the cylindrical tube 40 (the small-diameter section 12*b* of the outer tube 12) is fitted into the opening. The outer tube 60 is fitted into the cylindrical tube 40. The inner circumferential surface of the cylindrical tube 40 and the outer circumferential surface of the outer tube 60 come in close contact with both end portions in the forward/rearward direction. Meanwhile, an annular gap S2 is secured in an intermediate portion disposed between both end portions in the forward/rearward direction between the inner circumferential surface of the cylindrical tube 40 and the outer circumferential surface of the outer tube 60.

A first ventilation hole 63 configured to bring the inside of the outer tube 60 and the gap S2 in communication with each other is formed in the outer tube 60. A second ventilation hole 64 configured to bring the gap S2 and the gap S1 defined between the flange portion 12*c* of the outer tube 12 and the flange portion 13*c* of the inner tube 13 in communication with each other is formed in the flange portion 12*c* of the outer tube 12. Further, a third ventilation hole 65 configured to bring the gap S1 and the inside of the large-diameter section 13*a* and the mounting cap 14 of the inner tube 13 in communication with each other is formed in the flange portion 13*c* of the inner tube 13.

A first through-hole 66 that penetrates in the forward/rearward direction is formed in a portion of the rear wall portion 61 of the main cylinder 53 disposed above the piston guide 62. In the example shown, the tube protruding rearward is formed on the opening circumferential edge portion of the first through-hole 66 in the rear wall portion 61, and the tube is fitted into the through-hole formed in the small-diameter section 12*b* of the outer tube 12. The first through-hole 66 comes in communication with the space disposed between the seal tube 12*e* and the suction valve 36 in the inner tube 13 through a second through-hole 67 formed in the inner tube 13 of the vertical supply pipe 10. Accordingly, the inside of the main cylinder 53 comes in communication with the space in the inner tube 13 between the seal tube 12*e* and the suction valve 36 through the first through-hole 66 and the second through-hole 67. Accordingly, the suction valve 36 switches between communication and blocking between the inside of the container body A and the inside of the main cylinder 53.

The main piston 52 includes a columnar connecting portion 70 connected to the trigger 51 and a piston tube 71 disposed behind the connecting portion 70 and having a diameter larger than that of the connecting portion 70, and is formed in a cylindrical shape that opens rearward as a whole. Further, the main cylinder 53 and the main piston 52 are disposed on a common axis (not shown) extending in the forward/rearward direction.

The piston tube 71 includes a piston main body portion 72 that opens rearward and into which the piston guide 62 is inserted, and a sliding tube 73 protruding from the rear end portion of the piston main body portion 72 toward the outer side in the radial direction and coming in close sliding contact with the inner circumferential surface of the outer tube 60.

The piston main body portion 72 is formed to have an inner diameter that is larger than an outer diameter of the piston guide 62. In the example shown, a slight gap is formed between the inner circumferential surface of the piston main body portion 72 and the outer circumferential surface of the piston guide 62. The sliding tube 73 is formed in a tapered shape having a diameter that is gradually increased forward and rearward from the central portion in the forward/rearward direction, and sliding contact portions 73*a* disposed on both end portions in the forward/rearward direction come in sliding contact with the inner circumferential surface of the outer tube 60.

The connecting portion 70 of the main piston 52 is connected to the trigger 51 via connecting shafts 86, which will be described below. Accordingly, the main piston 52 is moved rearward and inserted into the main cylinder 53 according to rearward movement of the trigger 51 while being pushed forward by a pushing force of the elastic plate portions 54 together with the trigger 51.

In addition, when the trigger 51 is disposed at the foremost swinging position (the foremost moving position), the sliding tube 73 of the main piston 52 closes the first ventilation hole 63. Then, when the main piston 52 is moved rearward by a predetermined amount due to rearward swinging of the trigger 51, the sliding tube 73 opens the first ventilation hole 63. Accordingly, the inside of the container body A comes in communication with the outside through the third ventilation hole 65, the second ventilation hole 64 and the first ventilation hole 63.

The trigger 51 includes a main plate member 80 having a front surface curved in a concave shape recessed rearward in a side view when seen in the leftward/rightward direction, and a pair of side plate members 81 standing up rearward from left and right side edge portions of the main plate member 80.

A pair of connecting plates 82 extending upward to a side portion of the ejection barrel 11 and between which the ejection barrel 11 is sandwiched from the leftward/rightward direction are formed on upper end portions of the pair of side plate members 81. Rotary shaft portions 83 protrude toward the outside in the leftward/rightward direction from the pair of connecting plates 82. The rotary shaft portions 83 are pivotably supported by a bearing unit installed on an upper plate member 84 that covers an upper side of the ejection barrel 11. The upper plate member 84 is disposed above the ejection barrel 11 via a mounting tube 92, which will be described below. Accordingly, the trigger 51 is swingable about the rotary shaft portions 83 in the forward/rearward direction.

A connecting tube 85 is formed in the trigger 51 to extend rearward from the circumferential edge portion of the opening portion 51*a* while an opening portion 51*a* passing through the main plate member 80 in the forward/rearward direction is formed in the trigger 51. A pair of connecting shafts 86 protruding toward the inside of the connecting tube 85 in the leftward/rightward direction are formed on a portion of the inner circumferential surface of the connecting tube 85 disposed on the rear side. The connecting shafts 86 are inserted into connecting holes formed in the connecting portion 70 of the main piston 52. Accordingly, the trigger 51 and the main piston 52 are connected to each other.

Further, the connecting portion 70 of the main piston 52 is rotatable about the axis with respect to the connecting shafts 86, and connected to the connecting shafts 86 in order to be movable by a predetermined amount in the upward/downward direction. Accordingly, the main piston 52 is movable forward and rearward according to swinging of the trigger 51 in the forward/rearward direction.

The upper plate member 84 having a horizontal plate shape and connected to the top wall section 12*d* of the outer tube 12 in the vertical supply pipe 10 is attached to an upper surface of the ejection barrel 11. The elastic plate portions 54 formed in an arc shape protruding forward in the side view when seen in the leftward/rightward direction and extending to the lower side of the ejection barrel 11 are formed on both sides of the upper plate member 84 in the leftward/rightward direction. The elastic plate portions 54 are formed integrally with the upper plate member 84. The elastic plate portions 54 include a pair of leaf springs formed in arc shapes concentric with each other in a side view when seen in the leftward/rightward direction and disposed forward and rearward.

In the pair of leaf springs, the leaf spring on the front side is a main leaf spring 54*a*, and the leaf spring disposed on the rear side is an auxiliary leaf spring 54*b*. Lower end portions of the main leaf spring 54*a* and the auxiliary leaf spring 54*b* are integrally connected via a folded portion 54*c* having an arc shape. A locking piece 54*d* protrudes downward from the folded portion 54*c*, and the locking piece 54*d* is inserted and engaged with a pocket portion 81*a* formed on the side plate members 81 in the trigger 51 from above. Accordingly, the elastic plate portions 54 bias the trigger 51 toward the front side via the locking piece 54*d* and the pocket portion 81*a*.

The upper end portion of the main plate member 80 of the trigger 51 abuts a lower end portion of a restricting wall 123, which will be described below, due to the pushing by the elastic plate portions 54 from the rear side. Accordingly, the trigger 51 is positioned at the foremost swinging position. Further, when the trigger 51 is pulled to the rear side from the foremost swinging position, the elastic plate portions 54 are elastically deformed to move the folded portion 54*c* rearward via the locking piece 54*d*. Here, in the elastic plate portions 54, the auxiliary leaf spring 54*b* is elastically deformed to a greater extent than the main leaf spring 54*a*.

Further, the locking piece 54*d* maintains an engagement state with the pocket portion 81*a* until the trigger 51 reaches the rearmost swinging position (the rearmost moving position) while being extracted upward from the pocket portion 81*a* even when the trigger 51 is pulled rearward.

The nozzle member 3 is disposed in front of the ejector main body 2. The nozzle member 3 includes a nozzle plate 105, the mounting tube 92, the restricting wall 123, an insertion portion 201, a nozzle shaft portion 100 and a surrounding tube 101.

A front surface and a back surface of the nozzle plate 105 face the forward/rearward direction. The nozzle plate 105 covers the front end opening of the ejection barrel 11 from the front side. The nozzle plate 105 is disposed on the front end opening edge of the ejection barrel 11. The mounting tube 92 protrudes rearward from the nozzle plate 105. The mounting tube 92 is closely fitted onto the ejection barrel 11. A connecting hole 106 is formed in the nozzle plate 105. The connecting hole 106 is disposed on the inside of the mounting tube 92 in a plan view when the nozzle plate 105 is seen from the forward/rearward direction. The restricting wall 123 protrudes downward from the mounting tube 92. Since the lower end portion of the restricting wall 123 abuts the upper end portion of the main plate member 80 of the trigger 51 from the front side, the restricting wall 123 positions the trigger 51 at the foremost swinging position.

The insertion portion 201 extends rearward. The insertion portion 201 is inserted into the ejection barrel 11 substantially throughout the length in the forward/rearward direction. The insertion portion 201 is inserted into the ejection barrel 11 such that a slight gap S3 is secured in an upper portion in the internal space of the ejection barrel 11. Accordingly, a volume of a space in the ejection barrel 11 can be reduced. The gap S3 comes in communication with the connecting hole 106.

The nozzle shaft portion 100 and the surrounding tube 101 protrude forward from the nozzle plate 105. The surrounding tube 101 surrounds the nozzle shaft portion 100 on the outside thereof. The surrounding tube 101 slightly protrudes forward from the nozzle shaft portion 100. An annular flow passage 102 is formed between the nozzle shaft portion 100 and the surrounding tube 101. A nozzle cap 103 in which the ejection hole 4 opening forward is formed is mounted on the nozzle shaft portion 100, and the flow passage 102 and the ejection hole 4 come in communication with each other. The flow passage 102 comes in communication with the connecting hole 106. Accordingly, the inside of the reservoir cylinder 90 comes in communication with the ejection hole 4 through the communication hole 104, the inside of the ejection barrel 11, the connecting hole 106 and the flow passage 102. That is, the communication hole 104 comes in communication with the inside of the reservoir cylinder 90 and the ejection hole 4.

Further, as shown in FIG. 2, a position of the reservoir plunger 91 when the front end surface of the closing wall 111 abuts the rear end surface of the valve base portion 118 is referred to as the furthest advanced position. When the reservoir plunger 91 is disposed at the furthest advanced position, in addition to the fact that almost no liquid is contained in the reservoir cylinder 90, communication between the inside of the reservoir cylinder 90 and the communication hole 104 is blocked.

Figure 3:
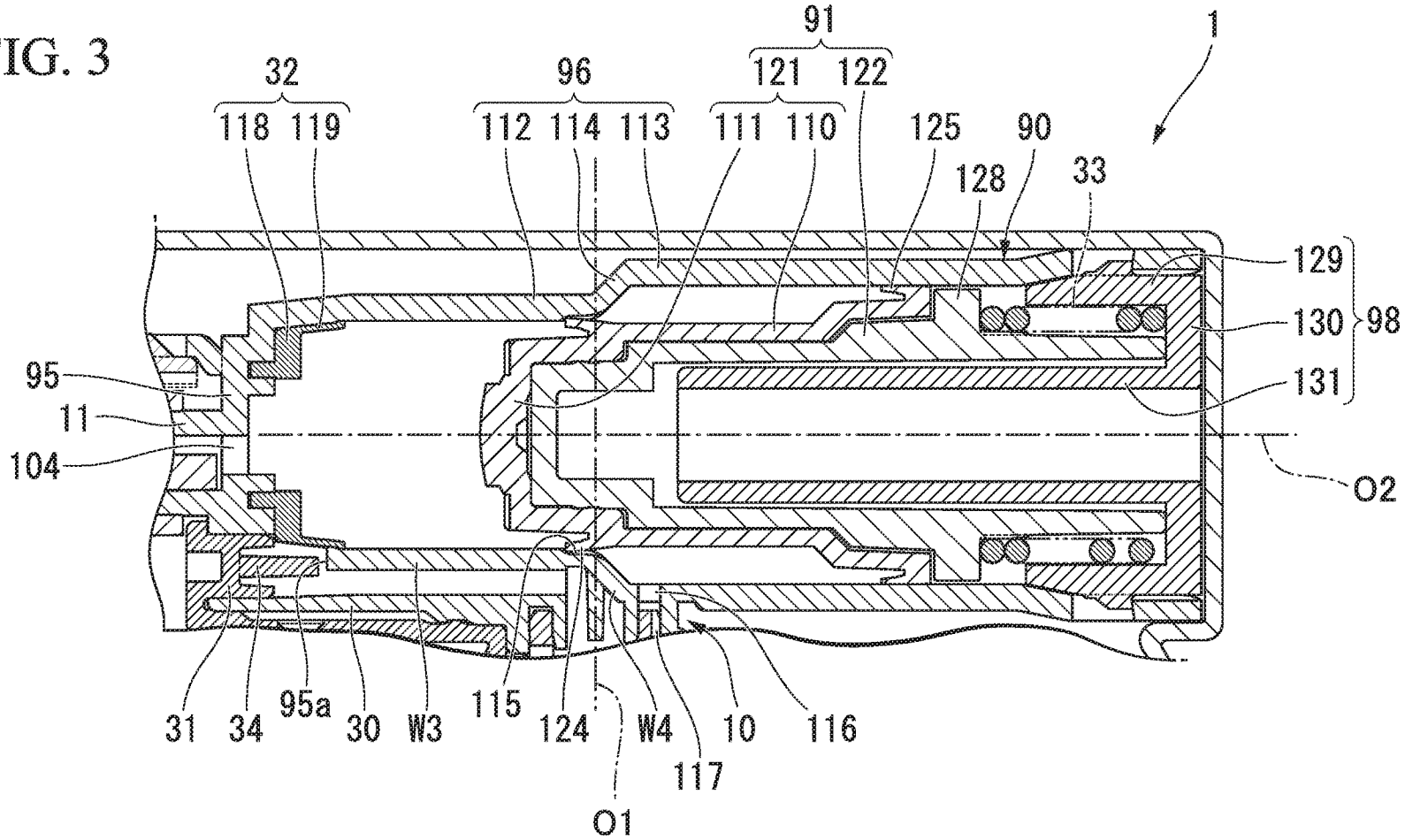
FIG. 3 is an enlarged longitudinal cross-sectional view of the major part shown in FIG. 2, showing a state in which a reservoir piston is retracted to a furthest retracted position.

As shown in FIG. 3, when the reservoir plunger 91 is moved toward the rear side (one side in the axial direction) and the reservoir plunger 91 abuts the restricting section 98 from the front side (the other side in the axial direction), further movement of the reservoir plunger 91 toward the rear side is restricted. The position of the reservoir plunger 91 at this time is referred to as the furthest retracted position. When the reservoir plunger 91 reaches the furthest retracted position, the rear end portion of the receiving member 122 abuts the connecting seat portion 130, and the maximum amount of liquid is contained in the reservoir cylinder 90.

Action of Trigger-Type Liquid Ejector

Next, the case in which the trigger-type liquid ejector 1 configured as above is used will be described. It is assumed that liquid is filled into each part of the trigger-type liquid ejector 1 by a plurality of operations of the trigger 51 such that the liquid can be suctioned from the vertical supply pipe 10.

Since the main piston 52 is retracted according to movement of the trigger 51 to the rear side when the trigger 51 is pulled rearward against the pushing force of the elastic plate portions 54, the liquid in the main cylinder 53 can be introduced into the inner tube 13 of the vertical supply pipe 10 through the first through-hole 66 and the second through-hole 67. Then, the liquid introduced into the inner tube 13 is supplied into the supply hole 95*a* through the connection tube 30 and the reservoir valve 32 is pushed up and opened while the suction valve 36 is pushed down and closed. Accordingly, the liquid can be introduced into the reservoir cylinder 90. Then, the reservoir plunger 91 can be moved rearward from the furthest advanced position, and the communication hole 104 can be opened by separating the front end surface of the closing wall 111 from the rear end surface of the valve base portion 118.

Accordingly, the liquid can be introduced into the ejection hole 4 through the communication hole 104, the inside of the ejection barrel 11, and the flow passage 102, the liquid can be injected forward from the ejection hole 4, and at the same time, the reservoir plunger 91 can be moved rearward.

In this way, whenever the trigger 51 is pulled rearward, the reservoir plunger 91 can be moved rearward and the liquid can be accumulated (filled) in the reservoir cylinder 90 while the liquid can be injected from the ejection hole 4. The reservoir plunger 91 in the reservoir cylinder 90 is moved to the rear side (one side in the axial direction) while elastically compressing and deforming the pushing member 33 in the forward/rearward direction according to introduction of the liquid to the reservoir cylinder 90. Accordingly, a pushing force is applied to the reservoir plunger 91 from the pushing member 33 toward the front side.

Then, when a pulling operation of the trigger 51 is stopped and the trigger 51 is released, since the trigger 51 is pushed forward and returned to its original position by the elastic recovering force of the elastic plate portions 54, the main piston 52 is moved forward according to thereto. For this reason, a negative pressure is generated in the main cylinder 53, and the liquid in the container body A can be suctioned to the vertical supply pipe 10 through the pipe 15 due to the negative pressure. Then, the newly suctioned liquid pushes up the suction valve 36 to open the valve, and is introduced into the main cylinder 53. Accordingly, the liquid can be prepared for the next injection. Further, the reservoir valve 32 is closed.

Here, while supply of the liquid from the connection tube 30 into the reservoir cylinder 90 is stopped, forward movement of the reservoir plunger 91 toward the furthest advanced position (return movement toward the other side in the axial direction) is started by the pushing force of the pushing member 33. Here, outflow of the liquid from the inside of the reservoir cylinder 90 into the connection tube 30 is restricted by the reservoir valve 32. Accordingly, the liquid accumulated in the reservoir cylinder 90 can be guided to the ejection hole 4 through the communication hole 104, the inside of the ejection barrel 11 and the flow passage 102, and the liquid can be injected to the front side through the ejection hole 4. In this manner, it is possible to inject the liquid and perform continuous injection of the liquid not only when the operation of pulling the trigger 51 backward is being performed, but also when the trigger 51 is not being operated.

In particular, the communication hole 104 in communication with the ejection hole 4 and the supply hole 95*a* in communication with the inside of the ejection barrel 11 are formed in the reservoir cylinder 90, and the reservoir plunger 91 directly closes the communication hole 104. For this reason, the volume of a space of a path between the connection tube 30 and the reservoir cylinder 90 (an internal volume occupied by the path) can be easily reduced with few restrictions. Accordingly, when the trigger 51 is operated, the liquid can be directed introduced from the inside of the connection tube 30 into the reservoir cylinder 90, the pressure in the reservoir cylinder 90 can be rapidly increased, and the reservoir plunger 91 can be easily moved rearward directly. For this reason, the liquid can be rapidly injected while minimizing the number of priming times. Accordingly, the user-friendliness is good and the operability is excellent.

In addition, since the volume of a space in the ejection barrel 11 is reduced by the insertion portion 201, the pressure in the ejection barrel 11 can be rapidly increased, and the liquid can be injected at a high spraying pressure.

Further, since the reservoir plunger 91 directly closes the communication hole 104, the liquid is not injected as long as the internal pressure of the reservoir cylinder 90 does not exceed a predetermined value. Accordingly, the liquid can be injected at an appropriate pressure (spraying pressure) without separately installing a high pressure valve or the like, and simplification of the configuration is easily achieved. Moreover, since the pressure can be accumulated by moving the reservoir plunger 91 pushed forward by the pushing force of the pushing member 33 toward the rear side, when the liquid is injected, the liquid can be injected in a state in which further pressure is applied to the liquid. In addition, when not in use, leakage of the liquid from the ejection hole 4 can be effectively minimized.

Further, when the reservoir plunger 91 advances, while the reservoir plunger 91 is moved to the furthest advanced position (the other end of the reservoir cylinder 90 in the axial direction) as long as an operation of pulling the trigger 51 is not performed again, the operation of pulling the trigger 51 may be repeatedly performed before that. In this case, the reservoir plunger 91 may be gradually moved rearward as a whole during repetition of retraction and advancing. Accordingly, the liquid can be gradually accumulated in the reservoir cylinder 90. Then, for example, when the reservoir plunger 91 is moved to the furthest retracted position, the liquid can be continuously injected for a long time until the reservoir plunger 91 is moved from the furthest retracted position to the furthest advanced position.

In addition, as shown in FIG. 3, in a state in which the reservoir plunger 91 is disposed at the furthest retracted position, the first lip portion 124 is disposed on the communicating groove 115. Here, the inside of the front tube 112 comes in communication with the collecting hole 116 through the communicating groove 115, and the inside of the reservoir cylinder 90 and the inside of the container body A come in communication with each other through the collecting hole 116 and the collecting passage 117.

As described above, according to the trigger-type liquid ejector 1 according to the first embodiment, when the liquid in the reservoir cylinder 90 is ejected from the ejection hole 4, outflow of the liquid from the reservoir cylinder 90 into the connection tube 30 can be restricted by the reservoir valve 32. Accordingly, for example, the pressure of the liquid ejected from the ejection hole 4 through the ejection barrel 11 can be easily increased, and the liquid can be ejected in an appropriate shape or the like. In addition, since the closing-off plug 31 is formed integrally with the main cylinder 53, an increase in the number of parts can be minimized.

In addition, since the connection tube 30 and the reservoir cylinder 90 are disposed parallel to the upward/downward direction to include the common partition wall W3, reduction in size of the ejector main body 2 can be achieved. In addition, the collecting passage 117 is formed in the ejector main body 2. Accordingly, in a state in which the reservoir plunger 91 is sufficiently moved to the rear side, and further, when the liquid is introduced into the reservoir cylinder 90, the liquid can be returned to the container body A from the collecting passage 117. Accordingly, an excessive increase of the pressure in the reservoir cylinder 90 can be suppressed, and for example, damage to the reservoir cylinder 90 or the like can be easily prevented.

Further, the technical scope of the present invention is not limited to the first embodiment and various modifications may be made without departing from the spirit of the present invention.

The collecting passage 117 may be not provided. The connection tube 30 and the reservoir cylinder 90 may not include the common partition wall W3. The vertical supply pipe 10 and the reservoir cylinder 90 may not include the common partition wall W4.

While the reservoir plunger 91 is moved rearward according to supply of the liquid to the reservoir cylinder 90 in the first embodiment, the present invention is not limited thereto. For example, a configuration in which the reservoir plunger 91 is moved forward according to supply of the liquid to the reservoir cylinder 90 may be employed. Further, a configuration in which the central axis O2 of the reservoir cylinder 90 extends in a direction different from the forward/rearward direction and the reservoir plunger 91 is moved in the axial direction along the central axis O2 (a direction different from the forward/rearward direction) may be employed.

While the reservoir plunger 91 is returned and moved using the pushing force applied from the pushing member 33 in the first embodiment, the present invention is not limited thereto. In addition to the pushing force from the pushing member 33 or instead of the pushing force, the configuration as described below may be employed. That is, a configuration including a negative pressure plunger in which the ejector main body 2 is connected to the reservoir plunger 91 and linked to movement of the reservoir plunger 91 in the axial direction, and a negative pressure cylinder configured to block communication between the other end opening in the axial direction and the outside while extending in the forward axial direction and in which the negative pressure plunger is accommodated to be movable toward one side in the axial direction may be employed. In this case, the reservoir plunger 91 in the reservoir cylinder 90 is moved toward the one side in the axial direction together with the negative pressure plunger in the negative pressure cylinder according to introduction of the liquid to the reservoir cylinder 90. Here, a closed space in the negative pressure cylinder disposed on the other side in the axial direction due to the negative pressure plunger reaches a negative pressure. Accordingly, a pushing force is applied toward the other side in the axial direction with respect to the negative pressure plunger and the reservoir plunger 91. As a result, the reservoir plunger 91 can be returned and moved using the pushing force. According to the configuration, since the negative pressure in the negative pressure cylinder is used when the reservoir plunger 91 is returned and moved, for example, even when the pushing force applied from another member such as the pushing member 33 or the like is not used, the reservoir plunger 91 can be returned and moved. Accordingly, a thrust force can be applied to the reservoir plunger 91 while achieving simplification of a structure.

Further, when the pushing member 33 is not used, the trigger-type liquid ejector may also be formed of only a synthetic resin material.

While the trigger 51 is swingable rearward in the first embodiment, a configuration in which the trigger 51 is moved rearward may be appropriately employed. For example, a configuration in which the trigger 51 is slidably movable rearward or the like may be employed.

In addition, substitution of the components in the first embodiment with known components may be appropriately performed and the above-mentioned variants may be appropriately combined without departing from the spirit of the present invention.

Second Embodiment

Figure 4:
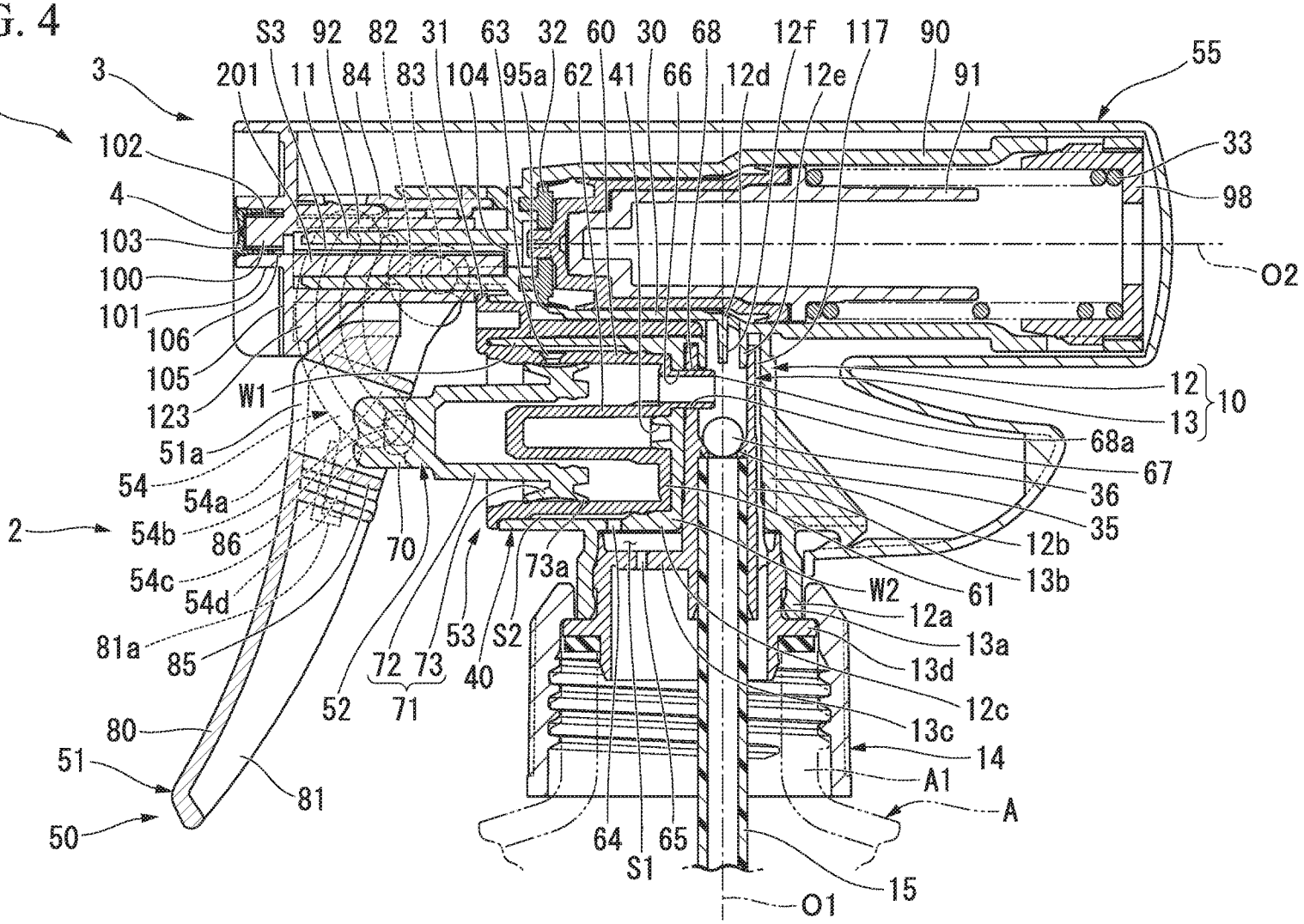
FIG. 4 is a longitudinal cross-sectional view showing a second embodiment of the trigger-type liquid ejector according to the present invention.
Figure 5:
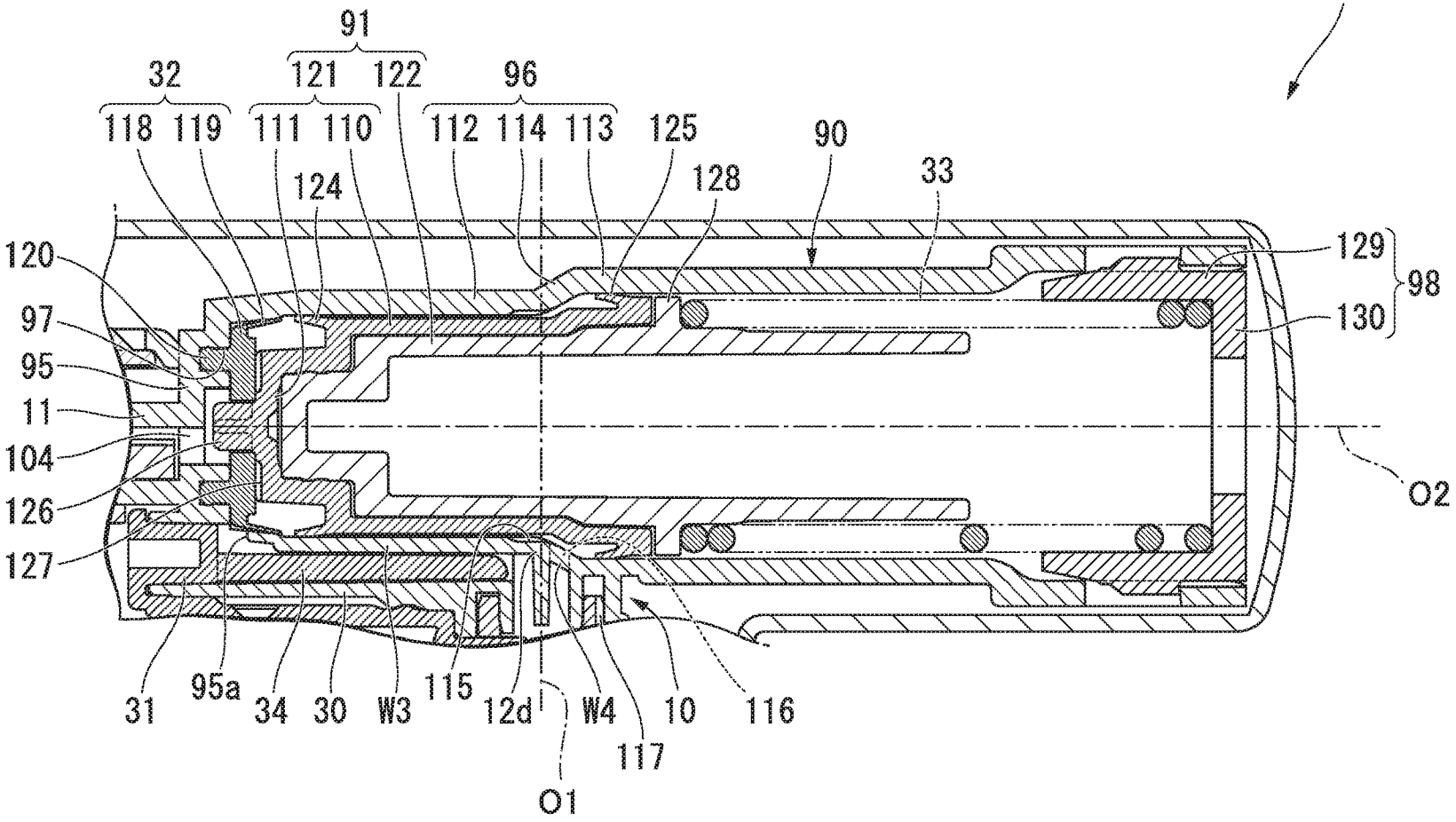
FIG. 5 is an enlarged longitudinal cross-sectional view of the major part including the reservoir cylinder that constitutes the trigger-type liquid ejector shown in FIG. 4.

Hereinafter, a second embodiment of the trigger-type liquid ejector according to the present invention will be described with reference to FIGS. 4 to 7. As shown in FIGS. 4 and 5, the trigger-type liquid ejector 1 of the second embodiment includes the ejector main body 2 mounted on the container body A in which a liquid is contained and having the vertical supply pipe 10 configured to suction the liquid, and the nozzle member 3 having the ejection hole 4 configured to eject the liquid forward and mounted on the ejector main body 2. Further, the components of the trigger-type liquid ejector 1 are molded articles using a synthetic resin unless the context clearly indicates otherwise.

Here, in the second embodiment, a central axis of the vertical supply pipe 10 is referred to as an axis O1, the container body A side along the axis O1 is referred to as a lower side, and a side opposite thereto is referred to as an upper side. In addition, a direction perpendicular to the axis O1 is referred to as a forward/rearward direction, and a direction perpendicular to both of the axis O1 direction and the forward/rearward direction is referred to as a leftward/rightward direction.

The ejector main body 2 includes the vertical supply pipe 10 extending in the upward/downward direction, and the ejection barrel 11 disposed in front of the vertical supply pipe 10 and having the inside in communication with the inside of the vertical supply pipe 10. The ejector main body 2 further includes the connection tube 30, the closing-off plug 31, the cylindrical tube 40, the reservoir cylinder 90, the reservoir valve 32, the reservoir plunger 91, the restricting section 98 and the pushing member 33. Further, in the forward/rearward direction, a direction in which the ejection barrel 11 is disposed from the vertical supply pipe 10 is referred to a front side or a forward side, and an opposite direction thereof is referred to as a rear side or a rearward side.

The vertical supply pipe 10 includes the outer tube 12 having a topped cylindrical shape, and the inner tube 13 fitted into the outer tube 12. The outer tube 12 includes the large-diameter section 12*a*, the small-diameter section 12*b* disposed above the large-diameter section 12*a* and having a diameter smaller than that of the large-diameter section 12*a*, and an annular connecting portion (a flange portion) 12*c* configured to connect an upper end portion of the large-diameter section 12*a* and a lower end portion of the small-diameter section 12*b*, and is formed in a two-part tubular form having a diameter reduced from the lower side toward the upper side. Further, an upper end opening mouth section of the small-diameter section 12*b* is covered with the top wall section 12*d*. The seal tube 12*e* and the restricting protrusion 12*f* are installed on the top wall section 12*d*. Both of the seal tube 12*e* and the restricting protrusion 12*f* extend downward from the top wall section 12*d* and are disposed coaxially with the axis O1. The seal tube 12*e* surrounds the restricting protrusion 12*f* from the outside.

The inner tube 13 includes the large-diameter section 13*a*, the small-diameter section 13*b* disposed above the large-diameter section 13*a* and having a diameter smaller than the large-diameter section 13*a*, and the flange portion 13*c* configured to connect an upper end portion of the large-diameter section 13*a* and a lower end portion of the small-diameter section 13*b*, and is formed in a two-part tubular form having a diameter that is reduced from the lower side toward the upper side. The seal tube 12*e* is fitted into the upper end portion of the small-diameter section 13*b*.

An upper portion of the pipe 15 disposed in the container body A and having a lower end opening disposed on a bottom portion (not shown) of the container body A is fitted into the small-diameter section 13*b* of the inner tube 13. The flange portion 13*c* of the inner tube 13 is disposed below the annular connecting portion 12*c* of the outer tube 12 in a state in which the gap S1 is secured between the annular connecting portion 12*c* of the outer tube 12 and the flange portion 13*c*. The annular brim portion 13*d* protruding toward the outside in the radial direction is formed on a portion of the large-diameter section 13*a* of the inner tube 13 protruding downward from the large-diameter section 12*a* of the outer tube 12. The brim portion 13*d* is disposed in the upper end portion of the mounting cap 14 mounted (for example, threadedly mounted) on the mouth section A1 of the container body A, and rotatably locks the upper end portion of the mounting cap 14 around the axis. The brim portion 13*d* is sandwiched between the mounting cap 14 and the upper end opening edge of the mouth section A1 of the container body A in the upward/downward direction. Further, the axis O1 of the vertical supply pipe 10 constituted by the outer tube 12 and the inner tube 13 is eccentric rearward with respect to the container shaft of the container body A.

The annular tapered tube 35 protruding inward is formed on a portion of the inner circumferential surface of the inner tube 13 disposed below the seal tube 12*e* and disposed above the upper end of the pipe 15. The tapered tube 35 has a diameter that gradually decreases downward. The spherical suction valve 36 seated on the inner circumferential surface of the tapered tube 35 and able to move away therefrom is disposed inside the tapered tube 35. The suction valve 36 brings a space in the inner tube 13 disposed above the tapered tube 35 and a space disposed below the tapered tube 35 in communication with each other, and blocks the communication.

The connection tube 30 extends forward from the vertical supply pipe 10. The connection tube 30 comes in communication with the inside of the vertical supply pipe 10. The rear end portion of the connection tube 30 is connected to the front side of the upper end portion in the vertical supply pipe 10. The rear end opening of the connection tube 30 is opened in the seal tube 12*e*. The closing-off plug 31 closes the front end opening of the connection tube 30. The closing-off plug 31 is closely fitted into the connection tube 30. The protrusion portion 34 protruding rearward is formed on the closing-off plug 31. The protrusion portion 34 reduces a flow path cross-sectional area of the connection tube 30.

The cylindrical tube 40 is formed integrally with a portion of the outer tube 12 disposed below the connection tube 30. The cylindrical tube 40 protrudes forward from the outer tube 12 and is opened forward. The cylindrical tube 40 is disposed between the connection tube 30 and the annular connecting portion 12*c*. The cylindrical tube 40 is disposed parallel to the connection tube 30 and the annular connecting portion 12*c* in the upward/downward direction. The cylindrical tube 40 includes the common partition walls W1 and W2 shared by the connection tube 30 and the annular connecting portion 12*c*.

The supply hole 95*a* in communication with the inside of the connection tube 30 is formed in the reservoir cylinder 90. The liquid passing through the inside of the vertical supply pipe 10 and the inside of the connection tube 30 is supplied into the reservoir cylinder 90 through the supply hole 95*a* by rearward swinging (movement) of the trigger 51. The reservoir cylinder 90 is disposed above the connection tube 30 while extending in the forward/rearward direction. The connection tube 30 and the reservoir cylinder 90 are disposed parallel to each other in the upward/downward direction to include the common partition wall W3. The reservoir cylinder 90 is disposed parallel to the connection tube 30 and the cylindrical tube 40. Further, in the example shown, the reservoir cylinder 90 is also disposed above the vertical supply pipe 10. The vertical supply pipe 10 and the reservoir cylinder 90 include the common partition wall W4. The partition wall W4 is formed by the top wall section 12*d*.

As shown in FIG. 5, the reservoir cylinder 90 includes the front wall portion 95, and the cylinder tube 96 extending rearward from the front wall portion 95, and is formed in a cylindrical shape that is opened rearward. The mounting concave portion 97 and the communication hole 104 are formed in the front wall portion 95. The mounting concave portion 97 is annularly formed coaxially with the central axis O2 of the reservoir cylinder 90. The mounting concave portion 97 is formed in the rear end surface of the front wall portion 95. The communication hole 104 is disposed inside the mounting concave portion 97 in a front view when the front wall portion 95 is seen from the forward/rearward direction. The communication hole 104 passes through the front wall portion 95 in the forward/rearward direction.

The cylinder tube 96 is formed in a multi-stage tubular form having a diameter that is gradually increased from the front side toward the rear side. The cylinder tube 96 includes the front tube 112 having a small diameter, the rear tube 113 having a large diameter, and the step portion 114 configured to connect the front tube 112 and the rear tube 113. The step portion 114 has a diameter that is gradually increased from the front side toward the rear side. The rear tube 113 protrudes rearward from the vertical supply pipe 10. The front tube 112 constitutes the partition wall W3. The rear end portion of the front tube 112, the step portion 114, and the front end portion of the rear tube 113 constitute the partition wall W4.

Figure 6:
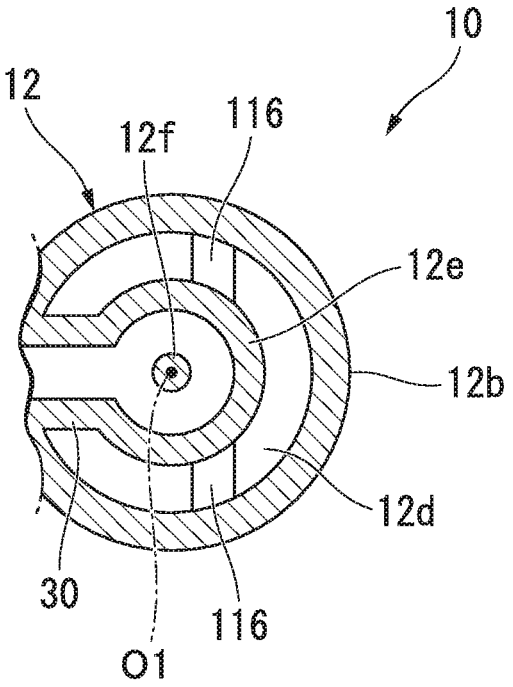
FIG. 6 is a lateral cross-sectional view of a vertical supply pipe that constitutes the trigger-type liquid ejector shown in FIG. 5, showing a state in which a top wall section is seen from the bottom.

The supply hole 95*a*, the communicating groove 115 and the collecting hole 116 are formed in the cylinder tube 96. The supply hole 95*a* is formed in the front end portion of the front tube 112. The supply hole 95*a* passes through the partition wall W3 in the upward/downward direction. The supply hole 95*a* exposes the protrusion portion 34 upward. The communicating groove 115 is formed in the rear end portion of the front tube 112. The communicating groove 115 is formed in the inner circumferential surface of the front tube 112. The communicating groove 115 extends in the forward/rearward direction and is opened rearward. The plurality of communicating grooves 115 are disposed around the central axis O2 at intervals. As shown in FIGS. 5 and 6, the collecting hole 116 is disposed in the step portion 114. The collecting hole 116 passes through the partition wall W4 in the upward/downward direction. The collecting hole 116 comes in communication with the collecting passage 117 formed in the ejector main body 2. As shown in FIG. 4, the collecting passage 117 is formed between the outer tube 12 and the inner tube 13. The collecting passage 117 vertically crosses the vertical supply pipe 10 in the upward/downward direction. The collecting passage 117 is formed in the outer circumferential surface of the inner tube 13 in a vertical groove shape. The collecting passage 117 passes through the small-diameter section 13*b* in the upward/downward direction, and comes in communication with the inside of the large-diameter section 13*a*. The collecting passage 117 brings the collecting hole 116 and the inside of the container body A in communication with each other.

As shown in FIG. 5, the reservoir valve 32 allows supply of the liquid to the reservoir cylinder 90 from the inside of the connection tube 30 through the supply hole 95*a*. The reservoir valve 32 restricts outflow of the liquid to the connection tube 30 from the inside of the reservoir cylinder 90 through the supply hole 95*a*. The reservoir valve 32 is a check valve. The reservoir valve 32 includes the valve base portion 118 and the valve body portion 119. The valve base portion 118 is annularly formed coaxially with the central axis O2. The valve base portion 118 is disposed on the rear end surface of the front wall portion 95. The valve base portion 118 includes the mounting convex portion 120 mounted in the mounting concave portion 97. The valve body portion 119 is formed in a cylindrical shape protruding rearward from the valve base portion 118. The valve body portion 119 is elastically deformable inside the valve body portion 119 in the radial direction. The rear end portion of the valve body portion 119 is seated on the inner circumferential surface of the cylinder tube 96 and able to move away therefrom. The rear end portion of the valve body portion 119 is disposed behind the supply hole 95*a*. The valve body portion 119 is able to close the supply hole 95*a* such that it can be freely opened and closed from the inside of the reservoir cylinder 90.

The reservoir plunger 91 is disposed in the reservoir cylinder 90 to be movable along the central axis O2 in the forward/rearward direction (the axial direction). The reservoir plunger 91 is pushed toward the front side (the other side) while moving toward the rear side (one side) in the forward/rearward direction according to supply of the liquid to the reservoir cylinder 90. The reservoir plunger 91 includes the sliding member 121 and the receiving member 122. Both of the sliding member 121 and the receiving member 122 are formed in a cylindrical shape extending in the forward/rearward direction. The sliding member 121 is fitted onto the receiving member 122. The sliding member 121 may be formed of, for example, a softer material than that of the receiving member 122.

The sliding member 121 slides in the reservoir plunger 91 in the forward/rearward direction. The sliding member 121 includes the plunger tube 110 extending in the forward/rearward direction, and the closing wall 111 configured to close the front end opening of the plunger tube 110. The plunger tube 110 is formed in a multi-stage cylindrical shape having a diameter that is gradually increased from the front side toward the rear side. The lip portions 124 and 125 are installed on the outer circumferential surface of the plunger tube 110. The lip portions 124 and 125 are formed on the plunger tube 110 in the circumferential direction throughout the circumference. The lip portions 124 and 125 closely slide on the inner circumferential surface of the cylinder tube 96 in the forward/rearward direction. The lip portions 124 and 125 are disposed in pair in the forward/rearward direction with an interval therebetween. The lip portions 124 and 125 include the first lip portion 124 on the front side, and the second lip portion 125 on the rear side. The first lip portion 124 slides on the inner circumferential surface of the front tube 112. The second lip portion 125 slides on the inner circumferential surface of the rear tube 113.

The front end surface of the closing wall 111 abuts the rear end surface of the valve base portion 118. Accordingly, the closing wall 111 closes the communication hole 104. The closing wall 111 is seated on the valve base portion 118 to be separable toward the rear side. The convex portion 126 and the concave groove 127 are formed in the front end surface of the closing wall 111. The convex portion 126 protrudes forward from the closing wall 111. The convex portion 126 is disposed inside the valve base portion 118. The concave groove 127 extends in the radial direction of the reservoir plunger 91. The concave groove 127 opens toward the outside in the radial direction. In a state in which the front end surface of the closing wall 111 abuts the rear end surface of the valve base portion 118, communication between the concave groove 127 and the communication hole 104 is blocked. The rear end portion of the receiving member 122 protrudes rearward from the sliding member 121. The receiving seat portion 128 is formed on the receiving member 122. The receiving seat portion 128 protrudes from the outer circumferential surface of the receiving member 122 in the radial direction of the receiving member 122. The receiving seat portion 128 is formed in an annular shape extending throughout the circumference of the receiving member 122 in the circumferential direction.

The restricting section 98 restricts a rearward moving amount of the reservoir plunger 91. The restricting section 98 is mounted in the rear end portion of the reservoir cylinder 90. The restricting section 98 is disposed coaxially with the central axis O2 and formed in a cylindrical shape extending in the forward/rearward direction. The restricting section 98 includes the fitting tube 129 and the connecting seat portion 130. The fitting tube 129 is fitted into the reservoir cylinder 90. The connecting seat portion 130 is annularly formed coaxially with the central axis O2. The outer circumferential edge portion of the connecting seat portion 130 is connected to the rear end portion of the fitting tube 129. The connecting seat portion 130 faces the rear end portion of the receiving member 122 in the forward/rearward direction.

The pushing member 33 biases the reservoir plunger 91 forward. The pushing member 33 is disposed between the reservoir plunger 91 and the restricting section 98. The front end portion of the pushing member 33 is disposed on the rear end surface of the receiving seat portion 128. The rear end portion of the pushing member 33 is disposed on the front end surface of the connecting seat portion 130. The pushing member 33 is compressed in the forward/rearward direction and biases the reservoir plunger 91 forward in a state in which the reservoir plunger 91 is disposed at the furthest advanced position, which will be described. The pushing member 33 is a coil spring and fitted onto the rear end portion of the receiving member 122.

As shown in FIGS. 4 and 5, the ejection barrel 11 guides the liquid in the vertical supply pipe 10 into the ejection hole 4. The ejection barrel 11 extends forward from the reservoir cylinder 90. The ejection barrel 11 protrudes forward from the front wall portion 95. The inside of the ejection barrel 11 comes in communication with the inside of the vertical supply pipe 11 through the communication hole 104, the inside of the valve base portion 118, the inside of the reservoir cylinder 90, the supply hole 95*a* and the inside of the connection tube 30.

As shown in FIG. 4, the ejector main body 2 further includes the trigger 51 extending downward from the ejection barrel 11 and disposed able to freely swing (freely move) rearward while being pushed forward from the vertical supply pipe 10, the main piston 52 coordinating with swinging (movement) of the trigger 51 and moved in the forward/rearward direction, the main cylinder 53 in which compression and decompression is performed according to movement of the main piston 52, the elastic plate portions 54 configured to bias the trigger 51 forward, and the cover body 55 configured to cover all of the vertical supply pipe 10, the ejection barrel 11 and the reservoir cylinder 90 at least upward and in the leftward/rightward direction.

In addition, the reservoir valve 32, the suction valve 36, the trigger 51, the main piston 52, the main cylinder 53 and the elastic plate portions 54, which are described above, constitute the trigger mechanism 50 configured to cause the liquid to flow from the inside of the vertical supply pipe 10 toward the ejection hole 4 through the inside of the ejection barrel 11 through rearward swinging (movement) of the trigger 51.

The inside of the main cylinder 53 comes in communication with the inside of the vertical supply pipe 10. The main cylinder 53 includes the outer tube 60 that opens forward, the rear wall portion 61 configured to close the rear opening portion of the outer tube 60, and the piston guide 62 having a front end closed while protruding forward from the central portion of the rear wall portion 61. The closing-off plug 31 is formed integrally with the main cylinder 53.

The inside of the piston guide 62 opens rearward, and the fitting protrusion 41 protruding forward from the rear wall in the cylindrical tube 40 (the small-diameter section 12*b* of the outer tube 12) is fitted into the opening. The outer tube 60 is fitted inside the cylindrical tube 40. The inner circumferential surface of the cylindrical tube 40 and the outer circumferential surface of the outer tube 60 come in close contact with both end portions in the forward/rearward direction. Meanwhile, the annular gap S2 is secured in an intermediate portion disposed between both end portions in the forward/rearward direction between the inner circumferential surface of the cylindrical tube 40 and the outer circumferential surface of the outer tube 60.

The first ventilation hole 63 configured to bring the inside of the outer tube 60 and the gap S2 in communication with each other is formed in the outer tube 60. The second ventilation hole 64 configured to bring the gap S2 and the gap S1 defined between the annular connecting portion 12*c* of the outer tube 12 and the flange portion 13*c* of the inner tube 13 in communication with each other is formed in the annular connecting portion 12*c* of the outer tube 12. Further, the third ventilation hole 65 configured to bring the gap S1 and the inside of the large-diameter section 13*a* of the inner tube 13 and the mounting cap 14 in communication with each other is formed in the flange portion 13*c* of the inner tube 13.

The communication tube 68 is formed on the main cylinder 53. The communication tube 68 protrudes rearward from the main cylinder 53 (in the forward/rearward direction). The communication tube 68 is disposed on a portion of the rear wall portion 61 of the main cylinder 53 positioned above the piston guide 62. The communication tube 68 is integrally inserted through the outer tube 12 and the inner tube 13. The first through-hole 66 is formed in the outer tube 12, and the second through-hole 67 is formed in the inner tube 13. The communication tube 68 is fitted into the second through-hole 67 through the first through-hole 66, and thus, downward extraction of the inner tube 13 from the outer tube 12 is restricted. The communication tube 68 is closely fitted into the inside of the first through-hole 66 and the inside of the second through-hole 67. The communication tube 68 brings the inside of the vertical supply pipe 10 and the inside of the main cylinder 53 in communication with each other. The inside of the communication tube 68 is in communication with a space in the inner tube 13 disposed between the seal tube 12*e* and the suction valve 36.

Accordingly, the inside of the main cylinder 53 is in communication with a space in the inner tube 13 disposed between the seal tube 12*e* and the suction valve 36 through the inside of the communication tube 68. Accordingly, the suction valve 36 switches communication between the inside of the container body A and the inside of the main cylinder 53 and blocking communication therebetween. Further, the suction valve 36 is closed when the inside of the main cylinder 53 is pressurized, and blocks the communication between the inside of the container body A and the inside of the main cylinder 53 through the inside of the vertical supply pipe 10. In addition, the suction valve 36 is opened as the main cylinder is displaced upward when the inside of the main cylinder 53 is decompressed, and brings the inside of the container body A and the inside of the main cylinder 53 in communication with each other through the inside of the vertical supply pipe 10. The communication tube 68 protrudes into the inner tube 13. A portion of the communication tube 68 disposed in the inner tube 13 functions as a valve pressing section 68*a*. The valve pressing section 68*a* is locked to the suction valve 36 when the suction valve 36 is open, and restricts further upward displacement of the suction valve 36.

The main piston 52 includes the columnar connecting portion 70 connected to the trigger 51, and the piston tube 71 disposed behind the connecting portion 70 and having a larger diameter than the connecting portion 70, and is formed in a cylindrical shape that opened rearward as a whole. Further, the main cylinder 53 and the main piston 52 are disposed on a common axis (not shown) extending in the forward/rearward direction.

The piston tube 71 includes the piston main body portion 72 that opens rearward and into which the piston guide 62 is inserted, and the sliding tube 73 protruding toward the outside in the radial direction from the rear end portion of the piston main body portion 72 in the radial direction and configured to come in close sliding contact with the inner circumferential surface of the outer tube 60.

The piston main body portion 72 is formed to have an inner diameter that is larger than an outer diameter of the piston guide 62. In the example shown, a slight gap is formed between the inner circumferential surface of the piston main body portion 72 and the outer circumferential surface of the piston guide 62. The sliding tube 73 is formed in a tapered shape having a diameter that is gradually increased forward and rearward from the central portion in the forward/rearward direction, and the sliding contact portions 73*a* disposed at both end portions in the forward/rearward direction come in sliding contact with the inner circumferential surface of the outer tube 60.

The connecting portion 70 of the main piston 52 is connected to the trigger 51 via the connecting shafts 86, which will be described below. Accordingly, the main piston 52 is moved rearward and inserted into the main cylinder 53 according to rearward movement of the trigger 51 while being pushed forward due to the pushing force of the elastic plate portions 54 together with the trigger 51.

In addition, when the trigger 51 is disposed at the foremost swinging position (the foremost moving position), the sliding tube 73 of the main piston 52 closes the first ventilation hole 63. Then, when the main piston 52 is moved rearward by a predetermined amount according to rearward swinging of the trigger 51, the sliding tube 73 opens the first ventilation hole 63. Accordingly, the inside of the container body A comes in communication with the outside through the third ventilation hole 65, the second ventilation hole 64 and the first ventilation hole 63.

The trigger 51 includes the main plate member 80 having a front surface curved rearward in a concave shape in a side view when seen in the leftward/rightward direction, and the pair of side plate members 81 standing up rearward from the left and right side edge portions of the main plate member 80.

The pair of connecting plates 82 extending upward until reaching a side portion of the ejection barrel 11 and with the ejection barrel 11 sandwiched therebetween from the leftward/rightward direction are formed on the upper end portions of the pair of side plate members 81. The rotary shaft portions 83 protrude toward the outside in the leftward/rightward direction from the pair of connecting plates 82. The rotary shaft portions 83 are pivotably supported by the bearing unit installed on the upper plate member 84 configured to cover an upper side of the ejection barrel 11. The upper plate member 84 is disposed above the ejection barrel 11 via the mounting tube 92, which will be described below. Accordingly, the trigger 51 is swingable about the rotary shaft portions 83 in the forward/rearward direction.

The opening portion 51*a* passing through the main plate member 80 in the forward/rearward direction is formed in the trigger 51, and the connecting tube 85 is formed in the trigger 51 to extend rearward from the circumferential edge portion of the opening portion 51*a*. The pair of connecting shafts 86 protruding toward the inside of the connecting tube 85 in the leftward/rightward direction are formed on a portion of the inner circumferential surface of the connecting tube 85 on the rear side. The connecting shafts 86 are inserted into the connecting hole formed in the connecting portion 70 of the main piston 52. Accordingly, the trigger 51 and the main piston 52 are connected to each other.

Further, the connecting portion 70 of the main piston 52 is connected to the connecting shafts 86 to be pivotable about the axis and movable in the upward/downward direction by a predetermined amount. Accordingly, the main piston 52 is movable forward and rearward according to swinging of the trigger 51 in the forward/rearward direction.

The upper plate member 84 having a horizontal plate shape is attached to an upper surface of the ejection barrel 11. The elastic plate portions 54 formed in an arc shape protruding forward in a side view when seen in the leftward/rightward direction and extending to the lower side of the ejection barrel 11 are formed on both sides of the upper plate member 84 in the leftward/rightward direction. The elastic plate portions 54 are formed integrally with the upper plate member 84. The elastic plate portions 54 include a pair of leaf springs formed in arc shapes in concentric with each other and arranged forward and rearward in a side view when seen in the leftward/rightward direction.

In the pair of leaf springs, the leaf spring disposed on the front side is the main leaf spring 54*a*, and the leaf spring disposed on the rear side is the auxiliary leaf spring 54*b*. Lower end portions of the main leaf spring 54*a* and the auxiliary leaf spring 54*b* are connected integrally with each other via the folded portion 54*c* having an arc shape. The locking piece 54*d* protruding downward is formed on the folded portion 54*c*, and the locking piece 54*d* is inserted into and engaged with the pocket portion 81*a* formed on the side plate members 81 in the trigger 51 from above. Accordingly, the elastic plate portions 54 bias the trigger 51 forward via the locking piece 54*d* and the pocket portion 81*a*.

The upper end portion of the main plate member 80 of the trigger 51 abuts the lower end portion of the restricting wall 123, which will be described below, by the pushing due to the elastic plate portions 54 from behind. Accordingly, the trigger 51 is positioned on the foremost swinging position. Further, when the trigger 51 is pulled rearward from the foremost swinging position, the elastic plate portions 54 are elastically deformed to move the folded portion 54*c* rearward via the locking piece 54*d*. Here, in the elastic plate portions 54, the auxiliary leaf spring 54*b* is more largely elastically deformed than the main leaf spring 54*a*.

Further, the locking piece 54*d* maintains an engagement state with the pocket portion 81*a* until the trigger 51 reaches the rearmost swinging position (the rearmost moving position) while the pocket portion 81*a* is extracted upward even when the trigger 51 is pulled rearward.

The nozzle member 3 is disposed in front of the ejector main body 2. The nozzle member 3 includes the nozzle plate 105, the mounting tube 92, the restricting wall 123, the insertion portion 201, the nozzle shaft portion 100 and the surrounding tube 101.

The front surface and the back surface of the nozzle plate 105 face each other in the forward/rearward direction. The nozzle plate 105 covers the front end opening of the ejection barrel 11 from the front. The nozzle plate 105 is disposed on the front end opening edge of the ejection barrel 11. The mounting tube 92 protrudes rearward from the nozzle plate 105. The mounting tube 92 is closely fitted onto the ejection barrel 11. The connecting hole 106 is formed in the nozzle plate 105. The connecting hole 106 is disposed inside the mounting tube 92 in a plan view when the nozzle plate 105 is seen from the forward/rearward direction. The restricting wall 123 protrudes downward from the mounting tube 92. Since the lower end portion of the restricting wall 123 abuts the upper end portion of the main plate member 80 of the trigger 51 from the front, the restricting wall 123 positions the trigger 51 at the foremost swinging position.

The insertion portion 201 extends rearward. The insertion portion 201 is inserted into the ejection barrel 11 substantially throughout the length in the forward/rearward direction. The insertion portion 201 is inserted into the ejection barrel 11 such that a slight gap S3 is secured in an upper portion of the internal space of the ejection barrel 11. Accordingly, a volume of a space in the ejection barrel 11 can be reduced. The gap S3 comes in communication with the connecting hole 106.

The nozzle shaft portion 100 and the surrounding tube 101 protrude forward from the nozzle plate 105. The surrounding tube 101 surrounds the nozzle shaft portion 100 from the outside. The surrounding tube 101 slightly protrudes forward from the nozzle shaft portion 100. The annular flow passage 102 is formed between the nozzle shaft portion 100 and the surrounding tube 101. The nozzle cap 103 having the ejection hole 4 that opens forward is mounted on the nozzle shaft portion 100, and the flow passage 102 and the ejection hole 4 come in communication with each other. The flow passage 102 comes in communication with the connecting hole 106. Accordingly, the inside of the reservoir cylinder 90 comes in communication with the ejection hole 4 through the communication hole 104, the inside of the ejection barrel 11, the connecting hole 106 and the flow passage 102. That is, the communication hole 104 comes in communication with the inside of the reservoir cylinder 90 and the ejection hole 4.

Further, the position of the reservoir plunger 91 when the front end surface of the closing wall 111 abuts the rear end surface of the valve base portion 118 as shown in FIG. 5 is the furthest advanced position. When the reservoir plunger 91 is disposed at the furthest advanced position, in addition to the fact that almost no liquid is contained in the reservoir cylinder 90, communication between the inside of the reservoir cylinder 90 and the communication hole 104 is blocked.

Figure 7:
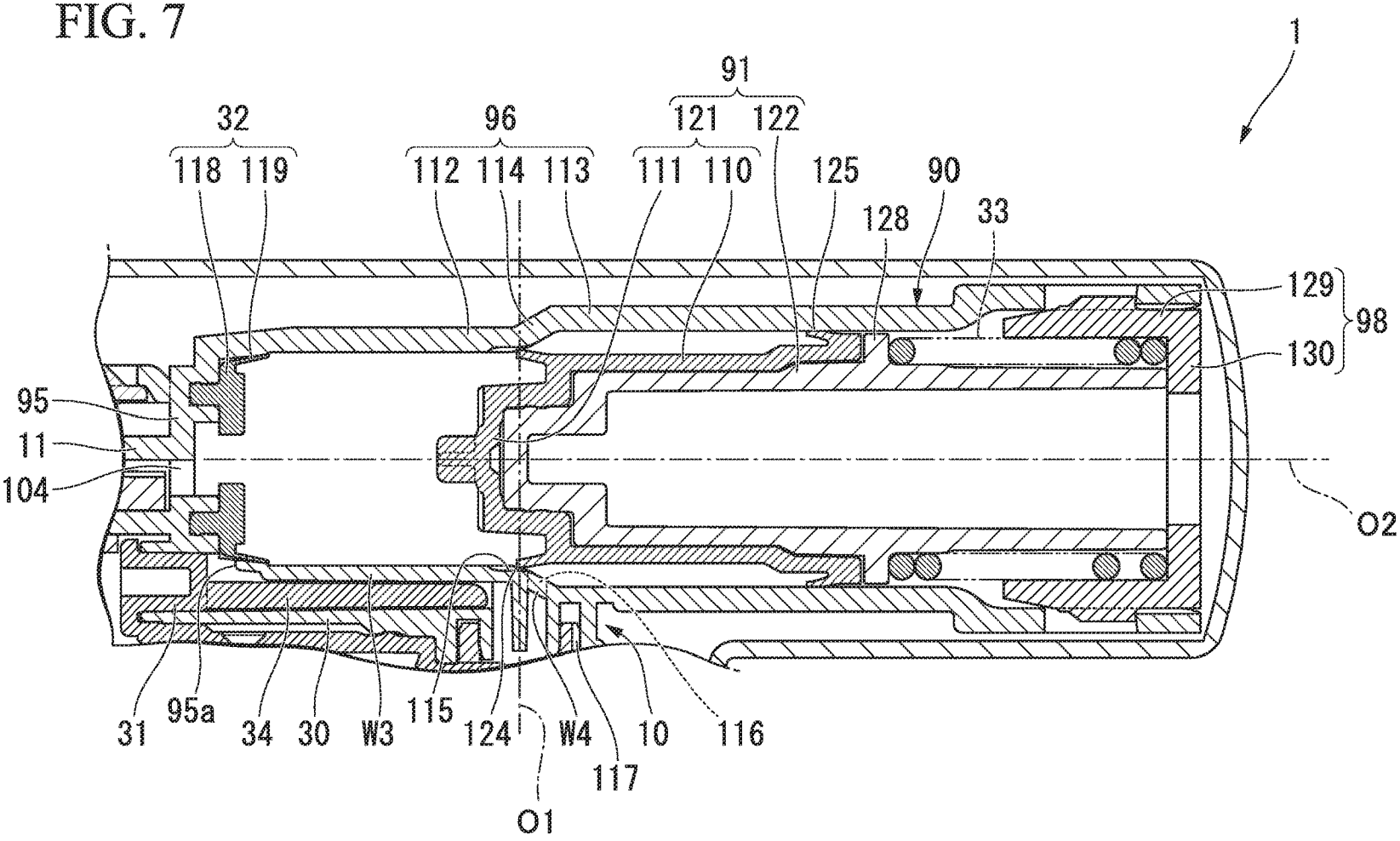
FIG. 7 is an enlarged longitudinal cross-sectional view of the major part shown in FIG. 5, showing a state in which the reservoir piston is retracted to the furthest retracted position.

As shown in FIG. 7, when the reservoir plunger 91 is moved toward the rear side (one side in the axial direction) and the reservoir plunger 91 abuts the restricting section 98 from the front side (the other side in the axial direction), further rearward movement of the reservoir plunger 91 is restricted. The position of the reservoir plunger 91 at this time is the furthest retracted position. When the reservoir plunger 91 reaches the furthest retracted position, the rear end portion of the receiving member 122 abuts the connecting seat portion 130, and a maximum amount of liquid is contained in the reservoir cylinder 90.

Action of Trigger-Type Liquid Ejector

Next, the case in which the trigger-type liquid ejector 1 configured as above is used will be described. Further, the parts of the trigger-type liquid ejector 1 are filled with the liquid and the liquid can be suctioned from the vertical supply pipe 10 by a plurality of times of operations of the trigger 51.

When the trigger 51 is pulled rearward against the pushing force of the elastic plate portions 54, since the main piston 52 is retracted according to rearward movement of the trigger 51, the liquid in the main cylinder 53 can be introduced into the inner tube 13 of the vertical supply pipe 10 through the inside of the communication tube 68. Then, the liquid introduced into the inner tube 13 closes the suction valve 36 by pushing down the suction valve 36, is supplied into the supply hole 95*a* through the connection tube 30, and opens the reservoir valve 32 by pushing up the reservoir valve 32. Accordingly, the liquid can be introduced into the reservoir cylinder 90. Then, the reservoir plunger 91 can be moved rearward from the furthest advanced position, and the front end surface of the closing wall 111 can be separated from the rear end surface of the valve base portion 118 to open the communication hole 104.

Accordingly, the liquid can be guided into the ejection hole 4 through the communication hole 104, the inside of the ejection barrel 11 and the flow passage 102, the liquid can be injected forward from the ejection hole 4, and at the same time, the reservoir plunger 91 can be moved rearward.

In this way, whenever an operation of pulling the trigger 51 rearward is performed, the liquid in the reservoir cylinder 90 can be accumulated (filled) by moving the reservoir plunger 91 rearward while the liquid can be injected from the ejection hole 4. The reservoir plunger 91 in the reservoir cylinder 90 is moved toward the rear side (one side in the axial direction) while elastically compressively deforming the pushing member 33 in the forward/rearward direction according to introduction of the liquid to the reservoir cylinder 90. Accordingly, a pushing force from the pushing member 33 toward the front side is applied to the reservoir plunger 91.

Then, when an operation of pulling the trigger 51 is stopped and the trigger 51 is released, since the trigger 51 is pushed forward to return to its original position by the elastic recovering force of the elastic plate portions 54, the main piston 52 is moved forward according to this. For this reason, a negative pressure is generated in the main cylinder 53, and the liquid in the container body A can be suctioned into the vertical supply pipe 10 through the pipe 15 due to the negative pressure. Then, a newly suctioned liquid opens the suction valve 36 by pushing up the suction valve 36 and is introduced into the main cylinder 53. Accordingly, the liquid can be prepared for the next injection. Further, the reservoir valve 32 is closed. In addition, an upward moving amount of the suction valve 36 is restricted by the valve pressing section 68*a*.

Here, while supply of the liquid from the connection tube 30 into the reservoir cylinder 90 is stopped, forward movement of the reservoir plunger 91 toward the furthest advanced position (return movement toward the other side in the axial direction) is started by the pushing force of the pushing member 33. Here, outflow of the liquid from the inside of the reservoir cylinder 90 into the connection tube 30 is restricted by the reservoir valve 32. Accordingly, the liquid accumulated in the reservoir cylinder 90 can be guided into the ejection hole 4 through the communication hole 104, the inside of the ejection barrel 11 and the flow passage 102, and the liquid can be injected forward through the ejection hole 4. In this way, not only when an operation of pulling the trigger 51 rearward is performed but also when the trigger 51 is not operated, the liquid can be injected and continuous injection of the liquid can be performed.

In particular, the communication hole 104 in communication with the ejection hole 4 and the supply hole 95*a* in communication with the ejection barrel 11 are formed in the reservoir cylinder 90, and the reservoir plunger 91 directly closes the communication hole 104. For this reason, a volume of a space of the path (an internal volume occupied by the path) from the connection tube 30 to the reservoir cylinder 90 can be easily reduced with few restrictions. Accordingly, when the trigger 51 is operated, the liquid can be directly introduced from the inside of the connection tube 30 into the reservoir cylinder 90, the pressure in the reservoir cylinder 90 is rapidly increased, and the reservoir plunger 91 is easily directly moved rearward. For this reason, the liquid can be rapidly injected while minimizing the number of priming times. Accordingly, the use-friendliness is good and the operability is excellent.

In addition, since the volume of a space in the ejection barrel 11 is reduced by the insertion portion 201, the pressure in the ejection barrel 11 can be rapidly increased, and the liquid can be injected at a high spraying pressure.

Further, since the reservoir plunger 91 directly covers the communication hole 104, the liquid is not injected as long as the internal pressure of the reservoir cylinder 90 does not exceed a predetermined value. Accordingly, the liquid can be injected at an appropriate pressure (spraying pressure) without separately installing a high pressure valve or the like, and simplification of the configuration is easily achieved. Moreover, since the pressure is accumulated by moving the reservoir plunger 91 pushed forward toward the rear side using the pushing force of the pushing member 33, when the liquid is injected, the liquid can be injected in a state in which the pressure is further added to the liquid. In addition, when not in use, leakage of the liquid from the ejection hole 4 can be effectively minimized.

Further, when the reservoir plunger 91 advances, while the reservoir plunger 91 moves to the furthest advanced position (the other end of the reservoir cylinder 90 in the axial direction) as long as an operation of pulling the trigger 51 is not performed again, the operation of pulling the trigger 51 may be repeatedly performed before that. In this case, the reservoir plunger 91 gradually moves rearward as a whole while repeating the retreat and advance. Accordingly, the liquid can be gradually accumulated in the reservoir cylinder 90. Then, since the reservoir plunger 91 is moved to, for example, the furthest retracted position, the reservoir plunger 91 can continuously inject the liquid for a long time from the furthest retracted position to the furthest advanced position.

In addition, as shown in FIG. 7, in a state in which the reservoir plunger 91 is disposed at the furthest retracted position, the first lip portion 124 is disposed on the communicating groove 115. Here, the inside of the front tube 112 comes in communication with the collecting hole 116 through the communicating groove 115, and the inside of the reservoir cylinder 90 and the inside of the container body A come in communication with each other through the collecting hole 116 and the collecting passage 117. Accordingly, in a state in which the reservoir plunger 91 is sufficiently moved toward the rear side, when the liquid is further introduced into the reservoir cylinder 90, the liquid can be returned to the container body A from the collecting passage 117. Accordingly, an excessive increase in the pressure in the reservoir cylinder 90 can be minimized, and for example, damage or the like to the reservoir cylinder 90 can be easily prevented.

As described above, according to the trigger-type liquid ejector 1 of the second embodiment, the communication tube 68 is fitted into the second through-hole 67. Accordingly, even when sealability is not secured between the outer circumferential surface of the communication tube 68 and the inner circumferential surface of the first through-hole 66, a leakage of contents in the vertical supply pipe 10 to the outside through the first through-hole 66 or a short circuit between the inside of the vertical supply pipe 10 and the collecting passage 117 can be minimized by securing sealability between the outer circumferential surface of the communication tube 68 and the inner circumferential surface of the second through-hole 67. In addition, as the communication tube 68 is fitted into the second through-hole 67 through the first through-hole 66, downward extraction of the inner tube 13 from the outer tube 12 is restricted. Accordingly, assemblability of the trigger-type liquid ejector 1 can be improved.

In addition, a portion of the communication tube 68 disposed in the inner tube 13 functions as the valve pressing section 68*a*. Accordingly, an increase in the number of parts can be minimized, and excessive displacement of the suction valve 36 can be suppressed.

In addition, the reservoir valve 32 restricts outflow of the liquid from the inside of the reservoir cylinder 90 into the connection tube 30 through the supply hole 95*a*. Accordingly, when the liquid in the reservoir cylinder 90 is ejected from the ejection hole 4, outflow of the liquid from the reservoir cylinder 90 into the connection tube 30 can be restricted by the reservoir valve 32. Accordingly, for example, the pressure of the liquid ejected from the ejection hole 4 through the ejection barrel 11 can be easily increased, and the liquid can be ejected in an appropriate shape or the like.

In addition, since the closing-off plug 31 is formed integrally with the main cylinder 53, an increase in the number of parts can be minimized. In addition, since the connection tube 30 and the reservoir cylinder 90 are disposed parallel to each other in the upward/downward direction to include the common partition wall W3, reduction in size of the ejector main body 2 can be achieved.

Further, the technical scope of the present invention is not limited to the second embodiment and various modifications may be made without departing from the spirit of the present invention.

The connection tube 30 and the reservoir cylinder 90 may not include the common partition wall W3. The vertical supply pipe 10 and the reservoir cylinder 90 may not include the common partition wall W4.

While the reservoir plunger 91 is moved rearward according to supply of the liquid to the reservoir cylinder 90 in the second embodiment, the present invention is not limited thereto. For example, the reservoir plunger 91 may employ the configuration of forward movement according to supply of the liquid to the reservoir cylinder 90. Further, the configuration in which the central axis O2 of the reservoir cylinder 90 extends in a direction different from the forward/rearward direction and the reservoir plunger 91 is moved in the axial direction along the central axis O2 (a direction different from the forward/rearward direction) may be employed.

While the reservoir plunger 91 is returned and moved using the pushing force applied from the pushing member 33 in the second embodiment, the present invention is not limited thereto. In addition to the pushing force from the pushing member 33 or instead of the pushing force, the configuration as described below may also be employed. That is, a configuration in which the ejector main body 2 includes a negative pressure plunger connected to the reservoir plunger 91 and coordinating with the movement of the reservoir plunger 91 in the axial direction and a negative pressure cylinder extending in the axial direction, from which communication between the other end opening in the axial direction and the outside is blocked, and in which the negative pressure plunger is accommodated to be movable to one side in the axial direction, may be employed. In this case, the reservoir plunger 91 in the reservoir cylinder 90 is moved toward one side in the axial direction together with the negative pressure plunger in the negative pressure cylinder according to introduction of the liquid to the reservoir cylinder 90. Here, a closed space in the negative pressure cylinder disposed on the other side in the axial direction of the negative pressure plunger becomes a negative pressure. Accordingly, the pushing force is applied to the negative pressure plunger and the reservoir plunger 91 toward the other side in the axial direction. As a result, the reservoir plunger 91 can be returned and moved using the pushing force. According to the configuration, since the negative pressure in the negative pressure cylinder is used when the reservoir plunger 91 is returned and moved, for example, even though the pushing force applied from the other member such as the pushing member 33 or the like is not used, the reservoir plunger 91 can be returned and moved. Accordingly, a thrust force can be applied to the reservoir plunger 91 while achieving simplification of the structure. Further, since the pushing member 33 is not used, the trigger-type liquid ejector may be formed of only a synthetic resin material.

While the trigger 51 is swingable rearward in the second embodiment, the configuration in which the trigger 51 is moved rearward may be appropriately employed. For example, a configuration in which the trigger 51 is slidable rearward may be employed.

While the ejection barrel 11 extends forward from the reservoir cylinder 90 in the second embodiment, the present invention is not limited thereto. In addition, while the supply hole 95*a* and the communication hole 104 are separately formed in the second embodiment, the supply hole 95*a* may function as the communication hole 104. Further, the connection tube 30, the closing-off plug 31 and the reservoir valve 32 may not be provided. For example, the ejection barrel 11 may extend forward from the vertical supply pipe 10, and the reservoir cylinder 90 may be disposed above the ejection barrel 11. Further, in the configuration, if the reservoir valve 32 is not provided and the supply hole 95*a* functions as the communication hole 104, when the trigger 51 is moved rearward, contents can flow into the ejection hole 4 from the vertical supply pipe 10 through the ejection barrel 11, and contents can be supplied into the reservoir cylinder 90 from the vertical supply pipe 10 through the supply hole 95*a*. Then, when rearward movement of the trigger 51 is stopped, the contents in the reservoir cylinder 90 can flow into the ejection hole 4 through the supply hole 95*a* (the communication hole 104) and the ejection barrel 11.

While the suction valve 36 is a spherical ball valve and the suction valve 36 is switched to be opened and closed as the suction valve 36 is displaced in the second embodiment, the present invention is not limited thereto. For example, a configuration in which the suction valve 36 is formed to be elastically deformable and deformed upward may be employed. In this case, a configuration in which the suction valve 36 is opened as the suction valve 36 is deformed upward when the inside of the main cylinder 53 is decompressed and the valve pressing section 68*a* is locked to the suction valve 36, which is open, and restricts further upward deformation of the suction valve 36 may be employed.

The communication tube 68 may not protrude in the inner tube 13. In this case, for example, the restricting protrusion 12*f* may function as the valve pressing section 68*a*. While the liquid is ejected forward from the ejection hole 4 in the second embodiment, the present invention is not limited thereto. For example, the liquid may be ejected from the ejection hole 4 in a direction different from the forward direction.

In addition, the components in the second embodiment may be appropriately substituted with known components and the above-mentioned variants may be appropriately combined without departing from the spirit of the present invention.

INDUSTRIAL APPLICABILITY

According to the present invention, the liquid can be continuously injected.

REFERENCE SIGNS LIST

1 Trigger-type liquid ejector
2 Ejector main body
3 Nozzle member
4 Ejection hole
10 Vertical supply pipe
11 Ejection barrel
30 Connection tube
31 Closing-off plug
32 Reservoir valve
50 Trigger mechanism
51 Trigger
52 Main piston
53 Main cylinder
66 First through-hole
67 Second through-hole
68 Communication tube
68*a* Valve pressing section
90 Reservoir cylinder
91 Reservoir plunger
95*a* Supply hole
104 Communication hole
117 Collecting passage A Container body
A1 Mouth section
W3 Partition wall

The invention claimed is:

1. A trigger-type liquid ejector comprising:

a ejector main body mounted on a container body in which a liquid is contained; and a nozzle member disposed in front of the ejector main body and in which an ejection hole configured to inject a liquid forward is formed, wherein the ejector main body includes:

a vertical supply pipe extending in an upward/downward direction and configured to suction the liquid in the container body, an ejection barrel disposed in front of the vertical supply pipe and configured to guide the liquid in the vertical supply pipe into the ejection hole, and a trigger mechanism having a trigger disposed in front of the ejection barrel to be movable rearward in a state where the trigger is pushed forward, the trigger mechanism configured to cause the liquid to flow from an inside of the vertical supply pipe toward the ejection hole through an inside of the ejection barrel due to rearward movement of the trigger, wherein the trigger mechanism includes:

a main piston that moves in a forward/rearward direction in conjunction with movement of the trigger, and a main cylinder having an inside compressed and decompressed according to the movement of the main piston and comes in communication with the inside of the vertical supply pipe, wherein the ejector main body includes:

a connection tube extending forward from the vertical supply pipe, a closing-off plug formed integrally with the main cylinder and configured to close a front end opening of the connection tube, a reservoir cylinder in which a supply hole in communication with an inside of the connection tube and a communication hole in communication with the inside of the ejection barrel are formed, and into which the liquid passing through the inside of the vertical supply pipe and the inside of the connection tube is supplied through the supply hole due to rearward movement of the trigger, a reservoir plunger disposed in the reservoir cylinder to be movable along a central axis thereof in an axial direction and pushed toward the other side while moving to one side in the axial direction according to supply of the liquid to the reservoir cylinder, and a reservoir valve configured to restrict outflow of the liquid from an inside of the reservoir cylinder into the connection tube through the supply hole while allowing supply of the liquid from the inside of the connection tube into the reservoir cylinder through the supply hole, and wherein the ejection barrel extends forward from the reservoir cylinder.

2. The trigger-type liquid ejector according to claim 1, wherein the connection tube and the reservoir cylinder are disposed parallel to each other in the upward/downward direction to include a common partition wall.

3. The trigger-type liquid ejector according to claim 1, wherein a collecting passage configured to bring the inside of the reservoir cylinder and an inside of the container body in communication with each other when the reservoir plunger is moved toward the one side is installed in the ejector main body.

4. The trigger-type liquid ejector according to claim 1, wherein the vertical supply pipe includes an outer tube and an inner tube fitted into the outer tube, a collecting passage configured to bring the inside of the reservoir cylinder and an inside of the container body in communication with each other when the reservoir plunger is moved toward the one side is disposed between the outer tube and the inner tube, and a communication tube protruding from the main cylinder in the forward/rearward direction, fitted into a second through-hole formed in the inner tube through a first through-hole formed in the outer tube, and configured to bring the inside of the vertical supply pipe and the inside of the main cylinder into communication with each other is installed in the main cylinder.

5. The trigger-type liquid ejector according to claim 4, wherein the ejector main body includes a suction valve disposed in the vertical supply pipe and configured to switch communication between the inside of the container body and the inside of the main cylinder and blocking communication therebetween, the suction valve is closed when the inside of the main cylinder is pressurized and blocks the communication between the inside of the container body and the inside of the main cylinder through the inside of the vertical supply pipe, the suction valve is opened by being displaced or deformed upward when the inside of the main cylinder is decompressed, and brings the inside of the container body and the inside of the main cylinder in communication with each other through the inside of the vertical supply pipe, the communication tube protrudes into the inner tube, and a portion of the communication tube disposed in the inner tube is a valve pressing section locked to the suction valve when the suction valve is open and configured to restrict further upward displacement and deformation of the suction valve.

6. The trigger-type liquid ejector according to claim 4, wherein the connection tube and the reservoir cylinder are disposed parallel to each other in the upward/downward direction to include a common partition wall.

* * * * *